US007923930B1

(12) United States Patent
Wedding et al.

(10) Patent No.: US 7,923,930 B1
(45) **Date of Patent: *Apr. 12, 2011**

(54) PLASMA-SHELL DEVICE

(75) Inventors: Carol Ann Wedding, Toledo, OH (US); Donald K. Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 493 days.

This patent is subject to a terminal disclaimer.

(21) Appl. No.: 11/781,445

(22) Filed: Jul. 23, 2007

Related U.S. Application Data

(63) Continuation-in-part of application No. 11/041,739, filed on Jan. 25, 2005, now Pat. No. 7,247,989, which is a continuation-in-part of application No. 10/270,141, filed on Oct. 15, 2002, now Pat. No. 6,864,631, which is a continuation-in-part of application No. 09/967,922, filed on Oct. 2, 2001, now abandoned, which is a continuation of application No. 09/756,230, filed on Jan. 9, 2001, now abandoned, application No. 11/781,445, which is a continuation-in-part of application No. 10/431,446, filed on May 8, 2003, now Pat. No. 7,456,571.

(60) Provisional application No. 60/835,212, filed on Aug. 4, 2006, provisional application No. 60/175,715, filed on Jan. 12, 2000, provisional application No. 60/381,822, filed on May 21, 2002.

(51) Int. Cl.
*H01J 17/49* (2006.01)

(52) U.S. Cl. ..... 313/586; 313/582

(58) Field of Classification Search ..... 313/581, 313/582, 586, 583, 584, 585, 587; 345/60
See application file for complete search history.

(56) References Cited

U.S. PATENT DOCUMENTS

| | | | |
|---|---|---|---|
| 2,187,432 | A | 1/1940 | Powers |
| 2,644,113 | A | 6/1953 | Etzkorn |
| 3,050,654 | A | 8/1962 | Toulon |
| 3,264,073 | A | 8/1966 | Schmitt et al. |
| 3,365,315 | A | 1/1968 | Beck et al. |
| 3,602,754 | A | 8/1971 | Pfaender et al. |
| 3,607,169 | A | 9/1971 | Coxe |
| 3,646,384 | A | 2/1972 | Lay |
| 3,652,891 | A | 3/1972 | Janning |
| 3,654,680 | A | 4/1972 | Bode et al. |
| 3,666,981 | A | 5/1972 | Lay |
| 3,674,461 | A | 7/1972 | Farnand et al. |
| 3,699,050 | A | 10/1972 | Henderson |
| 3,793,041 | A | 2/1974 | Sowman |
| 3,811,061 | A | 5/1974 | Nakayama et al. |

(Continued)

*Primary Examiner* — Nimeshkumar D Patel
*Assistant Examiner* — Glenn Zimmerman
(74) *Attorney, Agent, or Firm* — Donald K. Wedding

(57) ABSTRACT

A plasma panel device having a multiplicity of gas filled plasma-shells, each plasma-shell being positioned on or in a substrate and electrically connected to conductors or electrodes to define a gas discharge pixel or subpixel. The plasma-shell comprises a hollow gas filled geometric body and includes plasma-disc, plasma-dome, plasma-sphere, and other geometric shapes. The substrate may be rigid, flexible, or semi-flexible with a flat, curved, or irregular surface. Each substrate may comprise a single layer or multiple layers of the same or different materials. Substrate composites may be used such as mixtures, dispersions, suspensions, and so forth. The device may comprise a single substrate or a dual substrate device. A plasma-shell device with a flexible substrate may be bendable and rollable in at least two directions, X and Y, looking at the top or plan view.

20 Claims, 10 Drawing Sheets

U.S. PATENT DOCUMENTS 3,838,998 A 10/1974 Matthews et al.
3,848,248 A 11/1974 MacIntyre
3,860,846 A 1/1975 Mayer
3,885,195 A 5/1975 Amano
3,916,584 A 11/1975 Howard et al.
3,927,342 A 12/1975 Bode et al.
3,935,494 A 1/1976 Dick et al.
3,964,050 A 6/1976 Mayer
3,969,718 A 7/1976 Strom
3,975,194 A 8/1976 Farnand et al.
3,990,068 A 11/1976 Mayer et al.
3,998,618 A 12/1976 Kreik et al.
4,027,188 A 5/1977 Bergman
4,035,690 A 7/1977 Roeber
4,038,577 A 7/1977 Bode et al.
4,075,025 A 2/1978 Rostoker
4,106,009 A 8/1978 Dick
4,119,422 A 10/1978 Rostoker
4,126,807 A 11/1978 Wedding et al.
4,126,809 A 11/1978 Wedding et al.
4,133,854 A 1/1979 Hendricks
4,163,637 A 8/1979 Hendricks
4,164,678 A 8/1979 Biazzo et al.
4,166,147 A 8/1979 Lange et al.
4,257,798 A 3/1981 Hendricks et al.
4,279,632 A 7/1981 Frosch et al.
4,290,847 A 9/1981 Johnson et al.
4,303,061 A 12/1981 Torobin
4,303,431 A 12/1981 Torobin
4,303,432 A 12/1981 Torobin
4,303,433 A 12/1981 Torobin
4,303,603 A 12/1981 Torobin
4,303,729 A 12/1981 Torobin
4,303,730 A 12/1981 Torobin
4,303,731 A 12/1981 Torobin
4,303,732 A 12/1981 Torobin
4,303,736 A 12/1981 Torobin
4,307,051 A 12/1981 Sargeant et al.
4,314,827 A 2/1982 Leitheiser et al.
4,322,378 A 3/1982 Hendricks
4,344,787 A 8/1982 Beggs et al.
4,349,456 A 9/1982 Sowman
4,363,646 A 12/1982 Torobin
4,391,646 A 7/1983 Howell
4,392,988 A 7/1983 Dobson et al.
4,415,512 A 11/1983 Torobin
4,459,145 A 7/1984 Elsholz
4,494,038 A 1/1985 Wedding et al.
4,525,314 A 6/1985 Torobin
4,542,066 A 9/1985 Delzant
4,547,233 A 10/1985 Delzant
4,548,196 A 10/1985 Torobin
4,548,767 A 10/1985 Hendricks
4,568,389 A 2/1986 Torobin
4,582,534 A 4/1986 Torobin
4,596,681 A 6/1986 Grossman et al.
4,618,525 A 10/1986 Chamberlain et al.
4,637,990 A 1/1987 Torobin
4,638,218 A 1/1987 Shinoda et al.
4,671,909 A 6/1987 Torobin
4,713,300 A 12/1987 Sowman et al.
4,737,687 A 4/1988 Shinoda et al.
4,743,511 A 5/1988 Sowman et al.
4,743,545 A 5/1988 Torobin
4,757,036 A 7/1988 Kaar et al.
4,777,154 A 10/1988 Torobin
4,778,502 A 10/1988 Garnier et al.
4,793,980 A 12/1988 Torobin
4,797,378 A 1/1989 Sowman
4,800,180 A 1/1989 McAllister et al.
4,865,875 A 9/1989 Kellerman
4,879,321 A 11/1989 Laroche
4,883,779 A 11/1989 McAllister et al.
4,963,792 A 10/1990 Parker
5,017,316 A 5/1991 Sowman
5,053,436 A 10/1991 Delgado
5,069,702 A 12/1991 Block et al.
5,077,241 A 12/1991 Moh et al.
5,185,299 A 2/1993 Wood et al.
5,212,143 A 5/1993 Torobin
5,225,123 A 7/1993 Torobin
5,326,298 A 7/1994 Hotomi
5,777,436 A * 7/1998 Lepselter ..... 313/582
5,793,158 A 8/1998 Wedding
5,984,747 A 11/1999 Bhagavatula et al.
6,255,777 B1 7/2001 Kim et al.
6,368,708 B1 4/2002 Brown et al.
6,380,678 B1 * 4/2002 Kim ..... 313/586
6,545,422 B1 4/2003 George et al.
6,570,335 B1 5/2003 George et al.
6,612,889 B1 9/2003 Green et al.
6,620,012 B1 9/2003 Johnson et al.
6,633,117 B2 10/2003 Shinoda et al.
6,646,388 B2 11/2003 George et al.
6,650,055 B2 11/2003 Ishimoto et al.
6,677,704 B2 1/2004 Ishimoto et al.
6,762,566 B1 7/2004 George et al.
6,764,367 B2 7/2004 Green et al.
6,791,264 B2 9/2004 Green et al.
6,794,812 B2 9/2004 Yamada et al.
6,796,867 B2 9/2004 George et al.
6,801,001 B2 10/2004 Drobot et al.
6,822,626 B2 11/2004 George et al.
6,836,063 B2 12/2004 Ishimoto et al.
6,836,064 B2 12/2004 Yamada et al.
6,841,929 B2 1/2005 Ishimoto et al.
6,857,923 B2 2/2005 Yamada et al.
6,864,631 B1 3/2005 Wedding
6,893,677 B2 5/2005 Yamada et al.
6,902,456 B2 6/2005 George et al.
6,914,382 B2 7/2005 Ishimoto et al.
6,930,442 B2 8/2005 Awamoto et al.
6,932,664 B2 8/2005 Yamada et al.
6,935,913 B2 8/2005 Wyeth et al.
6,969,292 B2 11/2005 Tokai et al.
6,975,068 B2 12/2005 Green et al.
7,005,793 B2 2/2006 George et al.
7,025,648 B2 4/2006 Green et al.
7,049,748 B2 5/2006 Tokai et al.
7,083,681 B2 8/2006 Yamada et al.
7,122,961 B1 10/2006 Wedding
7,125,305 B2 10/2006 Green et al.
7,137,857 B2 11/2006 George et al.
7,140,941 B2 11/2006 Green et al.
7,157,854 B1 * 1/2007 Wedding ..... 313/582
7,176,628 B1 2/2007 Wedding
7,247,989 B1 7/2007 Wedding
7,307,602 B1 12/2007 Wedding et al.
7,405,516 B1 * 7/2008 Wedding ..... 313/582
7,456,571 B1 * 11/2008 Wedding ..... 313/582
7,474,273 B1 * 1/2009 Pavliscak et al. ..... 343/909
7,535,175 B1 * 5/2009 Strbik et al. ..... 313/582
7,622,866 B1 * 11/2009 Wedding et al. ..... 313/582
7,628,666 B1 * 12/2009 Strbik et al. ..... 445/24
7,638,943 B1 * 12/2009 Wedding et al. ..... 313/582
2001/0028216 A1 10/2001 Tokai et al.
2003/0182967 A1 10/2003 Tokai et al.
2004/0033319 A1 2/2004 Yamada et al.
2004/0063373 A1 4/2004 Johnson et al.
2005/0095944 A1 5/2005 George et al.
2006/0097620 A1 5/2006 George et al.
2007/0015431 A1 1/2007 Green et al.

* cited by examiner

PLASMA-SHELL DEVICE

RELATED APPLICATIONS

Priority is claimed under 35 U.S.C. 119(e) for U.S. Provisional Application Ser. No. 60/835,212, filed Aug. 4, 2006. This application is also a continuation-in-part under 35 U.S.C 120 of U.S. patent application Ser. No. 11/041,739, filed Jan. 25, 2005, now U.S. Pat. No. 7,247,989 which is a continuation-in-part under 35 U.S.C. 120 of U.S. patent application Ser. No. 10/270,141, filed Oct. 15, 2002, now U.S. Pat. No. 6,864,631 which is a continuation-in-part of U.S. patent application Ser. No. 09/967,922, filed Oct. 2, 2001, now abandoned, which is a continuation of U.S. patent application Ser. No. 09/756,230 filled Jan. 9, 2001, now abandoned, with a claim of priority under 35 U.S.C. 119(e) of Provisional Application Ser. No. 60/175,715, filed Jan. 12, 2000. This application is also a continuation-in-part under 35 U.S.C. 120 of U.S. patent application Ser. No. 10/431,446 filed May 8, 2003, now U.S. Pat. No. 7,456,571 with a claim of priority under 35 U.S.C. 119(e) of Provisional Application Ser. No. 60/381,822, filed May 21, 2002.

FIELD OF THE INVENTION

This invention relates to the manufacture and use of a plasma-shell for use in a plasma discharge device, including a display panel (PDP). This invention particularly relates to a multiplicity of hollow plasma-shells positioned on or in a substrate and electrically connected to two or more electrical conductors such as electrodes. The hollow plasma-shells are filled with an ionizable gas and may be used as pixels or subpixels in a gas discharge plasma display panel (PDP) device. As used herein, plasma-shell comprises a hollow gas-filled body of a predetermined geometric shape such as a plasma-sphere, plasma-disc, plasma-dome, or like body. A plasma-sphere is a hollow gas-filled sphere. A plasma-disc is a hollow gas-filled body with two opposing substantially flat sides. Other sides or ends of the plasma-disc may be flat or round. A plasma-dome has a flat side and an opposing domed or round side such as a flat bottom and a domed or round top. Other sides or ends of the plasma-dome may also be flat or domed. A flat or round side of each plasma-shell is in contact with the surface of a substrate. The substrate may be rigid, flexible, or semi-flexible with a flat, curved, or irregular surface. In one embodiment, the device has a single substrate with the substrate being flexible so that the device is bendable and rollable.

BACKGROUND OF THE INVENTION

PDP Structures and Operation

A gas discharge plasma display panel (PDP) comprises a multiplicity of single addressable picture elements, each element being referred to as a cell or pixel. In a multicolor PDP, two or more cells or pixels may be addressed as sub-cells or sub-pixels to form a single cell or pixel. As used herein, cell or pixel means sub-cell or sub-pixel. Two or more electrodes are connected to a cell or pixel so as to provide a voltage potential across a gap containing an ionizable gas and cause a gas discharge. In a DC PDP, the electrodes are in contact with the gas. When sufficient voltage is selectively applied to the electrodes at a pixel, the gas discharges to produce photons of light.

The voltage at which the pixel gas will discharge and produce photons depends on a number of factors including the distance between the electrodes, the composition of the gas, and the pressure of the gas. For uniform electrical and optical characteristics throughout the display, the display must adhere to close tolerances which includes maintaining the required tolerances in the display structure, including cell geometry, and the fabrication methods. The prior art discloses a variety of plasma display structures, cell geometries, and fabrication methods.

In an AC gas discharge plasma display, one or more electrodes at a cell site are insulated from the gas with a dielectric. AC gas discharge display devices include both monochrome (single color) and multicolor (two or more colors). Examples of monochrome AC gas discharge (plasma) displays are well known in the prior art and include those disclosed in U.S. Pat. Nos. 3,559,190(Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference. Examples of multicolor AC plasma displays are well known in the prior art and include those disclosed in U.S. Pat. Nos. 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber) and 5,793,158 (Wedding), all incorporated herein by reference.

Dual Substrate DC PDP

This invention is directed to a DC gas discharge (plasma) display (DC PDP) containing plasma-shells. In one embodiment, hereof, the DC PDP comprises a structure with two opposing substrates, a dual or co-planar device, as disclosed in AC PDP and DC PDP references cited herein.

Dual substrate DC PDPs typically comprise an apertured center plate sandwiched between a pair of opposing substrates with each DC gas discharge cell or pixel being defined by an aperture, perforation, hole, or like opening in the center plate. In some variations, the openings may be longitudinal such as channels, slots, or grooves. Such apertures, perforations, holes, channels, slots, etc. may be formed in the surface of one or both opposing dual substrates with or without the center plate.

Examples of dual substrate DC PDPs are disclosed in the well known prior art, and include those disclosed in U.S. Pat. Nos. 3,553,458 (Schagen), 3,558,975 (Ogle), 3,600,626 (Kupsky), 3,629,638 (Veron), 3,644,925 (Kupsky), 3,683,364 (Holz et al.), 3,689,910 (Glaser), 3,704,386 (Cola), 3,766,420 (Ogle et al.), 3,788,722 (Milgram), 3,886,390 (Maloney et al.), 3,921,021 (Glaser et al.), 3,956,667 (Veith), 4,010,395 (Holz), 4,035,689 (Ogle et al.), 4,297,613 (Aboelfotoh), 4,329,616 (Holz et al.), 4,329,626 (Hillenbrand et al.), 4,340,840 (Aboelfotoh et al.), 4,388,550 (de Vries), 4,393,326 (Kamegaya et al.), 4,532,505 (Holz et al.), 6,160,348 (Choi), 6,428,377 (Choi), and Reissue 29,629 (Ogle), all incorporated herein by reference.

Single Substrate PDP

In another embodiment hereof, there is used an AC or DC PDP structure having a so-called single substrate or monolithic plasma display panel structure having one substrate with or without a top or front viewing envelope or dome. Single substrate or monolithic plasma display panel structures are known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195

(Amano), 3,935,494 (Dick et al.), 3,964,050 (Mayer), 4,106,009 (Dick), 4,164,678 (Biazzo et al.), 4,446,402 (Dick), 4,638,218 (Shinoda), 4,737,687 (Shinoda et al.), 7,176,628 (Wedding), 7,157,854 (Wedding), and 7,122,961 (Wedding), all incorporated herein by reference.

Segmented AC or DC PDP

In another embodiment hereof, there is used a segmented electrode structure for example as disclosed by U.S. Pat. Nos. 3,764,429 (Janning), 3,914,643 (Kupsky), and 3,944,868 (Kupsky), all incorporated herein by reference. In this structure, the electrodes or conductors form a FIG. 8 pattern with various electrode segments being selectively turned on to form any numeral from 0 to 9. If diagonal bars are added to make a British flag electrode configuration, alphabetical characters can also be formed, for example as disclosed in U.S. Pat. No. 6,408,988 (Hani et al.), incorporated herein by reference. A segmented display may also be structured to provide Arabic writing, for example as disclosed by U.S. Pat. No. 4,261,126 (Bezjian), incorporated herein by reference.

DC PDP Electronics

Electronics for addressing a DC PDP are well known in the prior art. Examples of such electronics are disclosed in the DC PDP prior art listed above and incorporated herein by reference. DC PDP electronics are also disclosed in U.S. Pat. Nos. 3,509,420 (Ogle), 3,531,685 (Holz), 3,780,341 (Holz et al.), 4,109,180 (Ogle et al.), 5,233,272 (Whang et al.), 5,424,612 (Kim), and 6,069,450 (Sakai et al.), all incorporated herein by reference.

DC PDP with Memory

DC PDP can be made with memory as disclosed in U.S. Pat. Nos. 3,921,021 (Glaser et al.), 4,020,280 (Kaneko et al.), 4,066,929 (Okamoto et al.), 4,297,613 (Aboelfotoh), 4,329,616 (Holz et al.), 4,340,840 (Aboelfotoh et al.), 4,342,993 (Holz), 4,386,348 (Holz et al.), 4,780,644 (Sakai et al.), 5,646,482 (Suzuki et al.), 5,730,637 (Suzuki et al.), 5,739,799 (Takahashi et al.), and 5,920,295 (Takahashi et al.), all incorporated herein by reference.

AC/DC PDP

This invention may be used with a hybrid PDP which uses both AC gas discharge and DC gas discharge. Examples of AC/DC PDP structures and methods of operating are disclosed in U.S. Pat. Nos. 4,613,854 (Holz et al.), 4,595,919 (Holz et al.), 4,575,716 (Holz et al.), 4,533,913 (Tezucar et al.), 4,518,894 (Andreadakis), 4,386,348 (Holz et al.), 4,373,157 (Holz et al.), 4,329,616 (Holz et al.), and 4,315,259 (McKee et al.), all incorporated herein by reference.

Related Prior Art

PDP Tubes

U.S. Pat Nos. 7,176,628 (Wedding), 7,157,854 (Wedding), and 7,122,961, (Wedding) disclose PDP structures with elongated display tubes (called Plasma-tubes) and are incorporated herein by reference.

The following prior art references relate to the use of elongated tubes in a PDP and are incorporated herein by reference.

U.S. Pat. No. 3,602,754 (Pfaender et al.) discloses a multiple discharge gas display panel in which filamentary or capillary size glass tubes are assembled to form a gas discharge panel. U.S. Pat. Nos. 3,654,680 (Bode et al.), 3,927,342 (Bode et al.), and 4,038,577 (Bode et al.) disclose a gas discharge display in which filamentary or capillary size gas tubes are assembled to form a gas discharge panel. U.S. Pat. No. 3,969,718 (Strom) discloses a plasma display system utilizing tubes arranged in a side-by-side, parallel fashion. U.S. Pat. No. 3,990,068 (Mayer et al.) discloses a capillary tube plasma display with a plurality of capillary tubes arranged parallel in a close pattern. U.S. Pat. No. 4,027,188 (Bergman) discloses a tubular plasma display consisting of parallel glass capillary tubes sealed in a plenum and attached to a rigid substrate. U.S. Pat. No. 5,984,747 (Bhagavatula et al.) discloses rib structures for containing plasma in electronic displays that are formed by drawing glass preforms into fiber-like rib components. The rib components are then assembled to form rib/channel structures suitable for flat panel displays. U.S. Patent Application 2001/0028216A1 (Tokai et al.) discloses a group of elongated illuminators in a gas discharge device. U.S. Pat. No. 6,255,777 (Kim et al.) and U.S. Patent Application Publication 2002/0017863 (Kim et al.) disclose a capillary electrode discharge PDP device and a method of fabrication.

The following U.S. Patents disclose PDP structures with elongated display tubes and are incorporated herein by reference. U.S. Pat. Nos. 6,914,382 (Ishimoto et al.), 6,893,677 (Yamada et al.), 6,857,923 (Yamada et al.), 6,841,929 (Ishimoto et al.), 6,836,064 (Yamada et al.), 6,836,063 (Ishimoto et al.), 6,794,812 (Yamada et al.), 6,677,704 (Ishimoto et al.), 6,650,055 (Ishimoto et al.), 6,633,117 (Shinoda et al.), 6,930,442 (Awamoto et al.), 6,932,664 (Yamada et al.), 6,969,292 (Tokai et al.), 7,049,748 (Tokai et al.), and 7,083,681 (Yamada et al.)

U.S. Patent Applications Publication Nos. 2004/0033319 (Yamada et al.) and 2003/0182967 (Tokai et al.) disclose PDP structures with elongated display tubes and are incorporated herein by reference:

As used herein elongated tube is intended to include capillary, filament, filamentary, illuminator, hollow rods, or other such terms. It includes an elongated enclosed gas-filled structure having a length dimension that is greater than its cross-sectional width dimension. The width of the tube is typically the viewing direction of the display. Also as used herein, an elongated plasma-tube has multiple gas discharge pixels of 100 or more, typically 500 to 1000 or more, whereas a plasma-shell typically has only one gas discharge pixel. In some special embodiments, the plasma-shell may have more than one pixel, i.e., 2, 3, or 4 pixels up to 10 pixels.

Related Prior Art

Microspheres, Beads, Ampoules, Capsules

The construction of a PDP out of gas-filled hollow plasma-shells is known in the prior art. Such plasma-shells are referred to as microspheres, beads, ampoules, capsules, bubbles, shells, and so forth. The following prior art relates to the use of plasma-shells in a display device and are incorporated herein by reference.

U.S. Pat. No. 2,644,113 (Etzkorn) discloses ampoules or hollow glass beads containing luminescent gases that emit a colored light. In one embodiment, the ampoules are used to radiate ultraviolet light onto a phosphor external to the ampoule itself. U.S. Pat. No. 3,848,248 (MacIntyre) discloses the embedding of gas-filled beads in a transparent dielectric.

The beads are filled with a gas using a capillary. The external shell of the beads may contain phosphor.

U.S. Pat. No. 3,998,618 (Kreick et al.) discloses the manufacture of gas-filled beads by the cutting of tubing. The tubing is cut into ampoules and heated to form shells. The gas is a rare gas mixture of 95% neon and 5% argon at a pressure of 300 Torr.

U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture that emits a color upon discharge and/or by using a glass shell made from colored glass. U.S. Pat. No. 4,963,792 (Parker) discloses a gas discharge chamber including a transparent dome portion. U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen. Japanese Patent 11238469A, published Aug. 31, 1999, by Tsuruoka Yoshiaki of Dainippon discloses a plasma display panel containing a gas capsule. The gas capsule is provided with a rupturable part, which ruptures when it absorbs a laser beam.

Also incorporated herein by reference is U.S. Pat. No. 6,864,631 (Wedding) which discloses a PDP constructed of microspheres filled with ionizable gas. Wedding '631 is a parent of this application.

Light-Emitting Elements

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material.

Other U.S. Patent Nos. issued to George et al. and his various joint inventors include U.S. Pat. Nos. 6,570,335 (George et al.), 6,612,889 (Green et al.), 6,620,012 (Johnson et al.), 6,646,388 (George et al.), 6,762,566 (George et al.), 6,764,367 (Green et al.), 6,791,264 (Green et al.), 6,796,867 (George et al.), 6,801,001 (Drobot et al.), 6,822,626 (George et al.), 6,902,456 (George et al.), 6,935,913 (Wyeth et al.), 6,975,068 (Green et al.), 7,005,793 (George et al.), 7,025,648 (Green et al.), 7,125,305 (Green et al.), 7,137,857 (George et al.), and 7,140,941 (Green et al.) all incorporated herein by reference.

Also incorporated herein by reference are U.S. Patent Applications Publication Nos. 2004/0063373 (Johnson et al.), 2004/0106349 (Green et al.), 2005/0095944 (George et al.), 2006/0097620 (George et al.), 2006/0205311 (Green et al.).

Related Prior Art

Methods of Producing Microspheres

In the practice of this invention, any suitable method or process may be used to produce the plasma-shells including plasma-spheres, plasma-domes, plasma-discs, and other geometric shapes. Methods and processes for the production of hollow shells or microspheres are well known in the prior art. Microspheres have been formed from glass, ceramic, metal, plastic and other inorganic and organic materials. Varying methods and processes for producing shells and microspheres have been disclosed and practiced in the prior art. Some of the prior art methods for producing microspheres are disclosed hereafter.

One method used to produce hollow glass microspheres comprises incorporating a blowing gas into the lattice of a glass while in frit form. The blowing gases typically include $SO_2$, $CO_2$, and $H_2O$. The frit is heated and glass bubbles are formed by the in-permeation of the blowing gas. Microspheres formed by this method have diameters ranging from about 5 μm to approximately 5,000 μm. This method produces shells with a residual blowing gas enclosed in the shell, which may quench a gas discharge. Because of the residual gases, microspheres produced with this method may not be acceptable for producing plasma-shells for a PDP.

Methods of manufacturing glass frit for forming hollow microspheres are disclosed by U.S. Pat. Nos. 4,017,290 (Budrick et al.) and 4,021,253 (Budrick et al.). Budrick et al. '290 discloses a process whereby occluded material gasifies to form the hollow microsphere. Hollow microspheres are disclosed in U.S. Pat. Nos. 5,500,287 (Henderson) and 5,501,871 (Henderson). According to Henderson '287, the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow shell as described in step D in column 3 of Henderson '287. Henderson '287 and '871 are limited to gases of small molecular size. Large molecule gases such as xenon, argon, and krypton used in plasma displays may be too large to be permeated through the frit material or wall of the microsphere. Helium, which has a small molecular size, may leak through the microsphere wall or shell.

U.S. Pat. No. 4,257,798 (Hendricks et al.) is incorporated herein by reference. Hendricks et al. '798 discloses a method for manufacturing small hollow glass spheres. The gases include argon, krypton, xenon, bromine, DT, hydrogen, deuterium, helium, hydrogen, neon and carbon dioxide. Other Hendricks patents for the manufacture of glass spheres include U.S. Pat. Nos. 4,133,854 and 4,186,637, both incorporated herein by reference.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder, which forces closed and detached the elongated cylinder from the coaxial blowing nozzle. Surface tension forces acting on the detached cylinder from the latter into a spherical shape, which is rapidly cooled and solidified by cooling means to form a glass microsphere.

In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No.

4,303,432 (Torobin) and WO 8000438A1 (Torobin), both incorporated herein by reference. The microspheres may also be produced using a centrifuge apparatus and method as disclosed by U.S. Pat. No. 4,303,433 (Torobin) and WO8000695A1 (Torobin), both incorporated herein by reference.

Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference. U.S. Pat. No. 3,607,169 (Coxe) discloses an extrusion method in which a gas is blown into molten glass and individual shells are formed. As the shells leave the chamber, they cool and a portion of the gas is trapped inside. Because the shells cool and drop at the same time, the shells may not form uniformly. It is also difficult to control the amount and composition of gas that remains in the shell. U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration and then dried and fired to form microspheres. Prior to firing, the microcapsules are sufficiently porous such that, if placed in a vacuum during the firing process, the gases are removed and the resulting microspheres will generally be impermeable to ambient gases. The shells formed with this method may be filled with a variety of gases and pressurized from near vacuums to above atmosphere. This is a suitable method for producing microspheres. However, shell uniformity may be difficult to control.

U.S. Patent Application Publication 2002/0004111 (Matsubara et al.), incorporated herein by reference, discloses a method of preparing hollow glass microspheres by adding a combustible liquid (kerosene) to a material containing a foaming agent. Methods for forming microspheres are also disclosed in U.S. Pat. Nos. 3,848,248 (MacIntyre), 3,998,618 (Kreick et al.), 4,035,690 (Roeber), discussed above and incorporated herein by reference. Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference.

Other prior art methods for forming microspheres are disclosed in the prior art including U.S. Pat. Nos. 3,528,809 (Farnand et al.), 3,975,194 (Farnand et al.), 4,025,689 (Kobayashi et al.), 4,211,738 (Genis), 4,307,051 (Sargeant et al.), 4,569,821 (Duperray et al.) 4,775,598 (Jaeckel), and 4,917,857 (Jaeckel et al.), all of which are incorporated herein by reference. These references disclose a number of methods which comprise an organic core such as naphthalene or a polymeric core such as foamed polystyrene which is coated with an inorganic material such as aluminum oxide, magnesium, refractory, carbon powder, and the like. The core is removed by pyrolysis, sublimation, or decomposition and the inorganic coating sintered at an elevated temperature to form a sphere or microsphere. Farnand et al. '809 discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum oxide or magnesium oxide. The core may also be coated with a metal oxide such as aluminum oxide and reduced to metal. The resulting hollow spheres are used for thermal insulation, plastic filler, and bulking of liquids such as hydrocarbons.

Farnand '194 discloses a similar process comprising polymers dissolved in naphthalene including polyethylene and polystyrene. The core is sublimed or evaporated to form hollow spheres or microballoons. Kobayashi et al. '689 discloses the coating of a core of polystyrene with carbon powder. The core is heated and decomposed and the carbon powder heated in argon at 3000° C. to obtain hollow porous graphitized spheres. Genis '738 discloses the making of lightweight aggregate using a nucleus of expanded polystyrene pellet with outer layers of sand and cement. Sargeant et al. '051 discloses the making of lightweight refractories by wet spraying core particles of polystyrene with an aqueous refractory coating such as clay with alumina, magnesia, and/or other oxides. The core particles are subject to a tumbling action during the wet spraying and fired at 1730° C. to form porous refractory. Duperray et al. '821 discloses the making of a porous metal body by suspending metal powder in an organic foam which is heated to pyrolyze the organic and sinter the metal. Jaeckel '598 and Jaeckel et al. '857 disclose the coating of a polymer core particle such as foamed polystyrene with metals or inorganic materials followed by pyrolysis on the polymer and sintering of the inorganic materials to form the sphere. Both disclose the making of metal spheres such as copper or nickel spheres which may be coated with an oxide such as aluminum oxide. Jaeckel et al. '857 further discloses a fluid bed process to coat the core.

SUMMARY OF INVENTION

This invention relates to the positioning of one or more plasma-shells in contact with a substrate and electrically connecting each plasma-shell to at least two electrical conductors such as electrodes. The plasma-shell may be positioned on the surface of the substrate or within the substrate. In accordance with one embodiment of this invention, insulating bathers are provided to prevent contact between the connecting electrodes. The plasma-shell may be of any suitable geometric shape such as a plasma-sphere, plasma-dome, or plasma-disc for use in a gas discharge plasma display panel (PDP) device. As used herein, plasma-shell includes plasma-sphere, plasma-dome and/or plasma-disc. As disclosed herein, this invention comprises a PDP with a multiplicity of plasma-shells of one geometric shape or a multiplicity of plasma-shells of other geometric shapes. Thus the PDP may comprise combinations of plasma-shells of the same or of different geometric shapes.

A plasma-sphere is a primarily hollow sphere with relatively uniform shell thickness. The hollow sphere contains an ionizable gas at a desired mixture and pressure. The gas is selected to produce visible, ultraviolet (UV), and/or infrared (IR) photons during gas discharge when a voltage is applied. The shell material is selected to optimize required dielectric and/or conductive properties and optical transmissivity. Additional beneficial materials such as luminescent substances may be added to the inside surface or outer surface of the sphere. Luminescent substances may also be added directly to the shell material, for example incorporated into the shell material during or after formation of the shell.

A plasma-disc is similar to the plasma-sphere in material composition and gas selection. The geometric shape differs from the plasma-sphere in that the plasma-disc has two opposing substantially flat sides such as the top and bottom. A plasma-sphere may be flattened to form a plasma-disc by applying heat and pressure simultaneously to the top and bottom of the sphere using two substantially flat and ridged members, either of which may be heated. The plasma-disc may have other sides that are substantially flat or round.

A plasma-dome is similar to a plasma-sphere and plasma-disc in material composition and ionizable gas selection. It differs in geometric shape in that one side is substantially flat and an opposite side is substantially round or domed. Other sides of the plasma-dome may be flat or domed. A plasma-sphere may be flattened on one or more sides to form a plasma-dome, typically by applying heat and pressure simultaneously to the top and bottom of the plasma-sphere using one substantially flat and ridged member and one substantially elastic member. In one embodiment, the substantially rigid member is heated. As used herein a dome side has a substantially curved or round surface that is convex.

This invention is illustrated and discussed in the drawings with respect to plasma-spheres. However, plasma-shells of other geometric shapes including combinations of different plasma-shells are contemplated. The PDP may comprise plasma-shells of one geometric shape or combinations of geometric shapes. Thus the PDP may comprise various combinations of pairs of plasma-shells such as plasma-spheres and plasma-discs, plasma-spheres and plasma-domes, or plasma-discs and plasma-domes. Also three or more different plasma-shells may be used such as combinations of plasma-spheres, plasma-discs, plasma-domes, and/or plasma-shells of other geometric shapes.

DETAILED DESCRIPTION OF THE DRAWINGS

Figure 1:
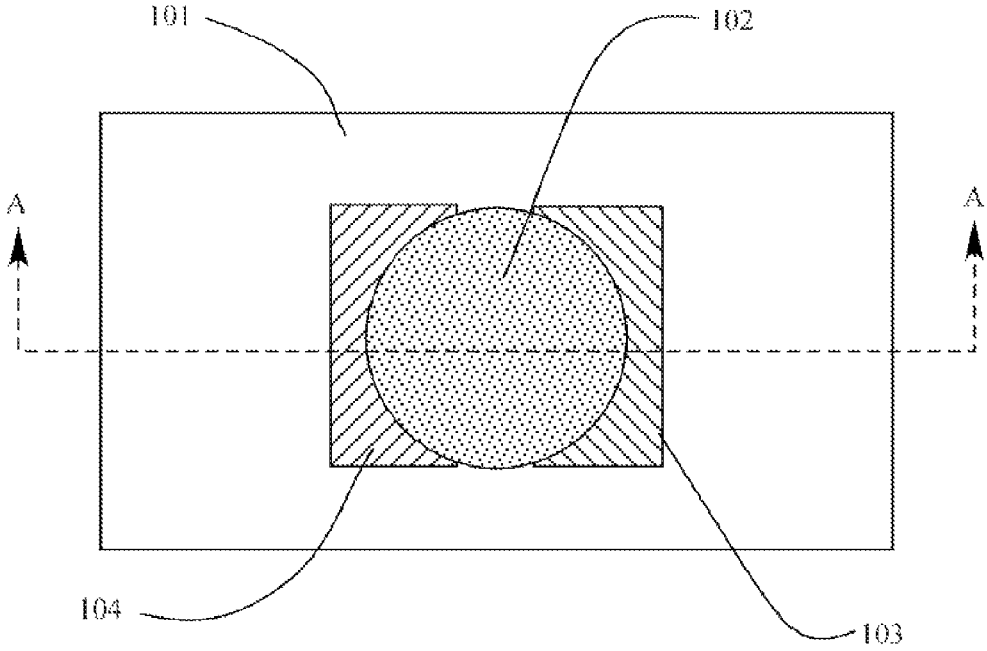
FIG. 1 shows a top plan view of a plasma-shell mounted on a single substrate.

FIG. 1 shows a top plan view of a single substrate plasma-shell 102 connected to two electrodes, 104 and 103, and substrate 101. The plasma-shell 102 is in the shape of a microsphere or plasma-sphere. Other geometric shapes may be used.

Figure 1A:
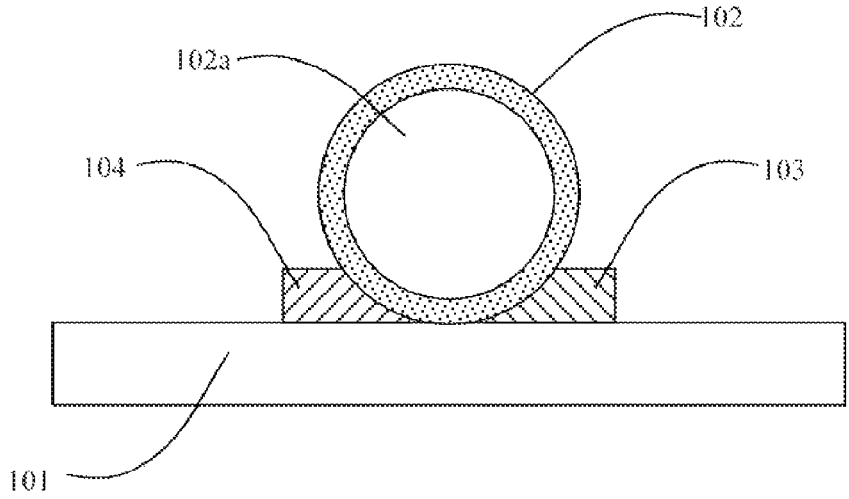
FIG. 1A is a section A-A view of FIG. 1.

FIG. 1A is a section A-A view of the hollow gas-filled plasma-shell 102 electrically connected to electrodes 104 and 103, and positioned on the surface of the single substrate 101. The plasma-shell 102 is filled with gas 102*a*.

Figure 2:
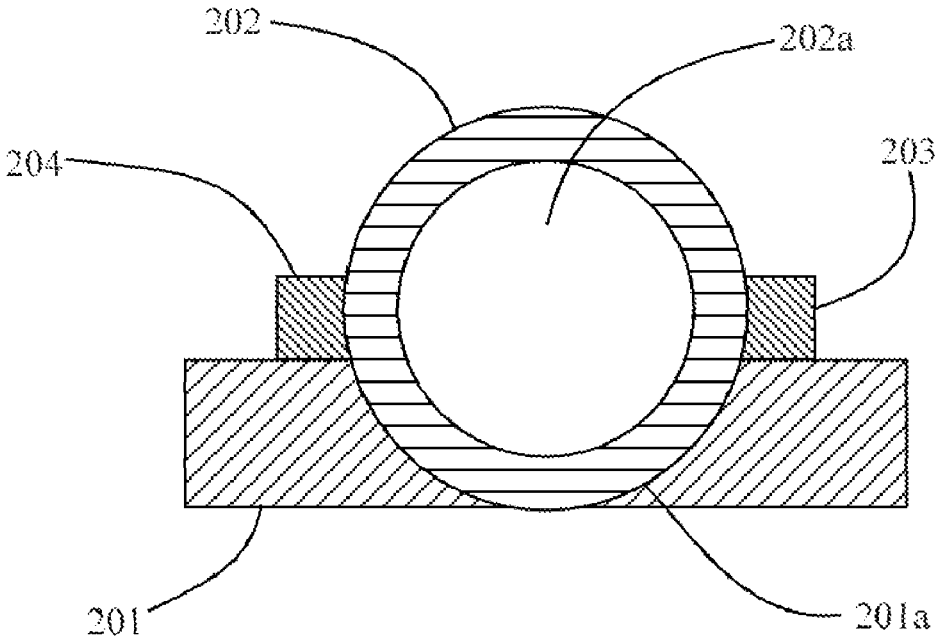
FIG. 2 shows a cross sectional view of a single substrate AC gas discharge (plasma) display panel with a plasma-shell.

FIG. 2 shows a cross sectional view of the plasma-shell 202 positioned in a well 201*a* within the surface of a single PDP substrate 201. The plasma-shell 202 is in the shape of a microsphere or plasma-sphere. The plasma-shell 202 is connected to two electrodes 203 and 204, and is filled with gas 202*a*.

The PDP substrate 101 or 201 may be constructed of a rigid, flexible, or semi-flexible material. It may be opaque, transparent, translucent, or non-light transmitting. Although the FIGS. 1 and 2 show a two-electrode system, three or more electrodes can be connected to each plasma-shell as illustrated in FIGS. 3 and 4.

Figure 3:
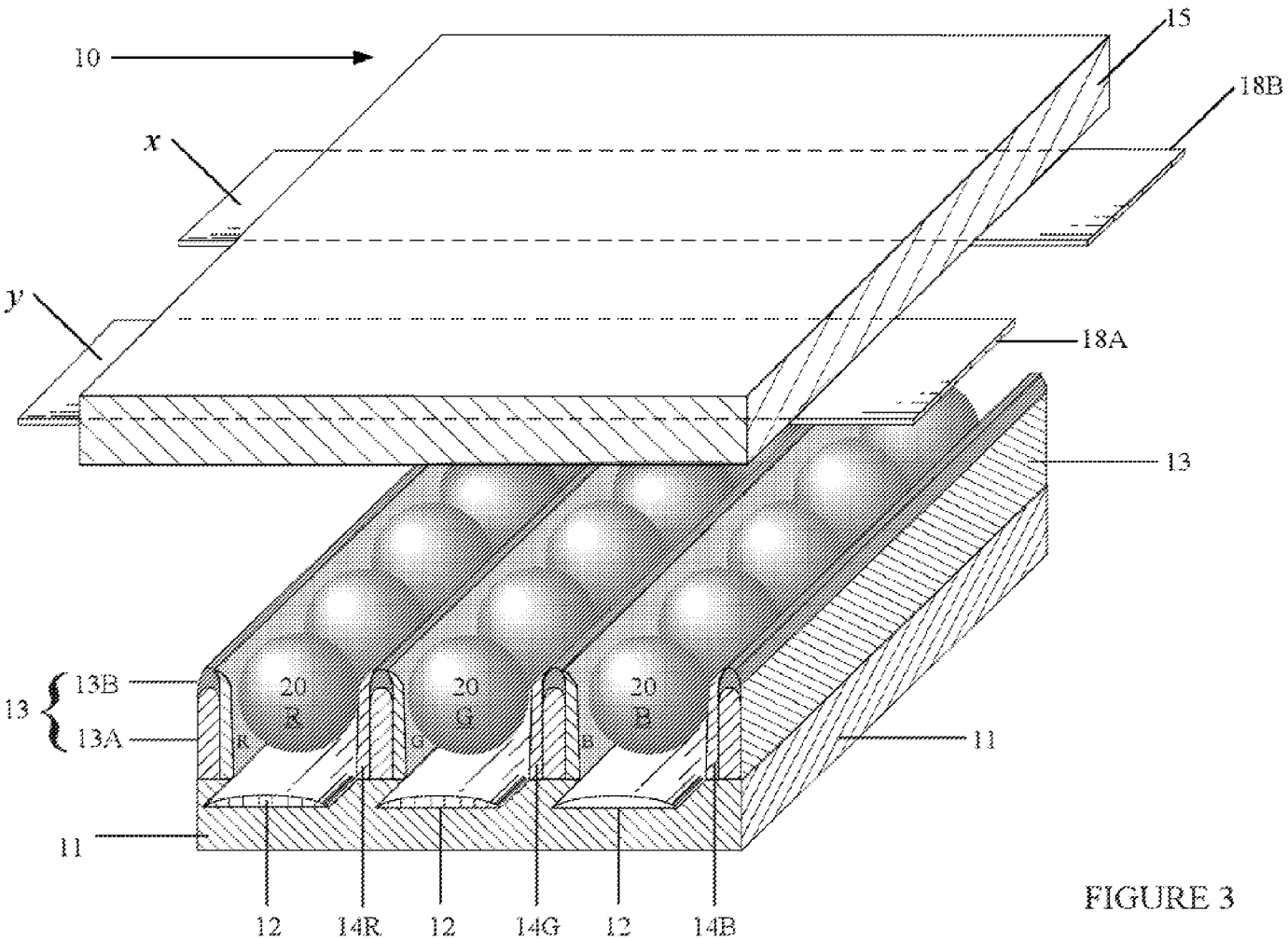
FIG. 3 shows a prospective view of an AC gas discharge (plasma) display panel with dual substrates and gas-filled plasma-shells.
Figure 4:
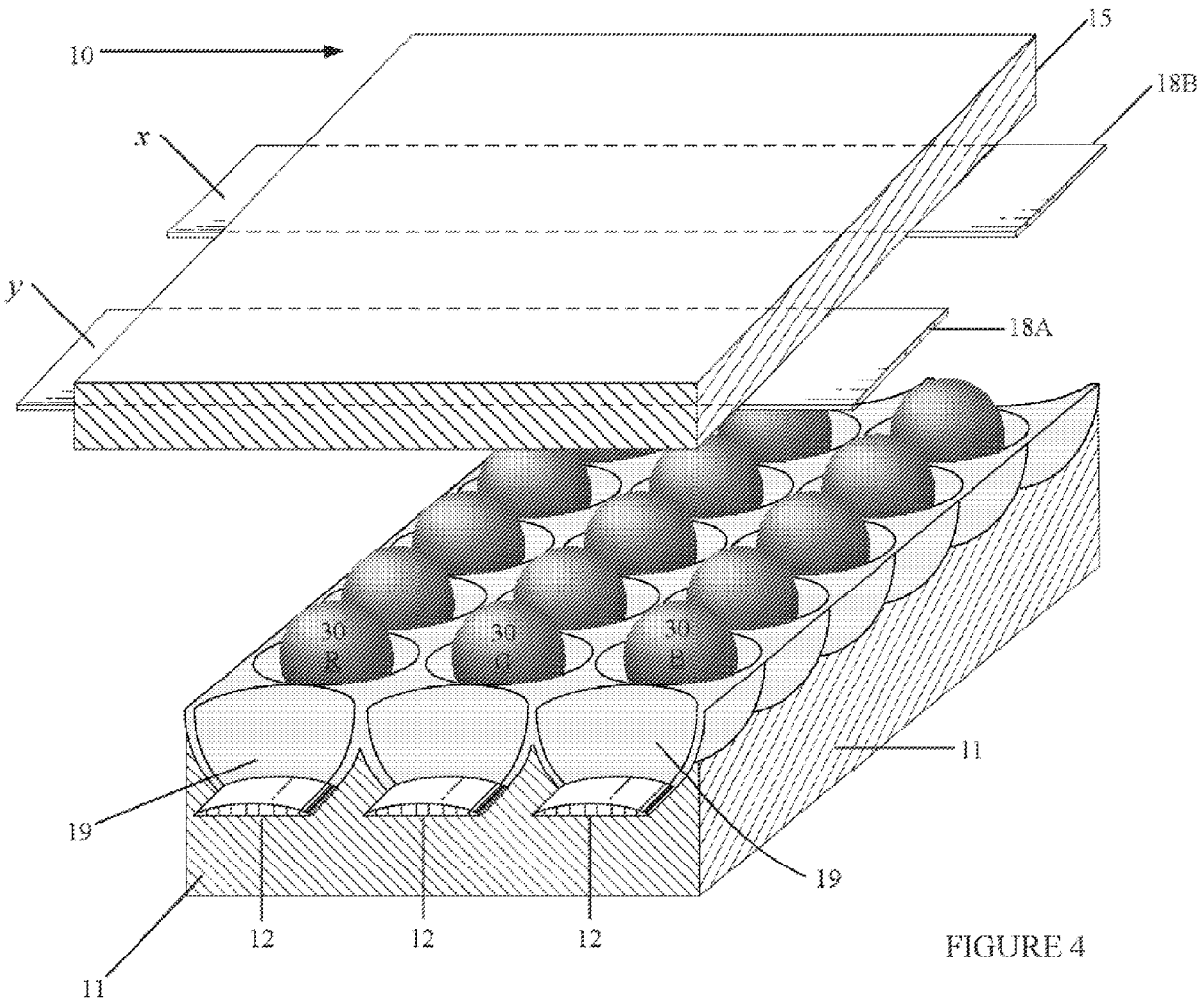
FIG. 4 shows a prospective view of a variation of the display structure in FIG. 3.

FIG. 3 shows plasma-shells 20R, 20G, 20B in a two-substrate surface discharge AC plasma display panel 10 with three electrodes. The panel structure 10 has a bottom or rear glass substrate 11 with electrodes 12 and a top substrate 15 with electrodes 18A and 18B. A plurality of channels are formed by the barriers 13. The plasma-shells 20R, 20G, and 20B, are positioned within the channels in contact with electrodes 12, 18A, and 18B. The electrical connection between the electrodes and the shell can be enhanced with a conductive material. The two substrates 11 and 15 are sealed together.

Figure 6:
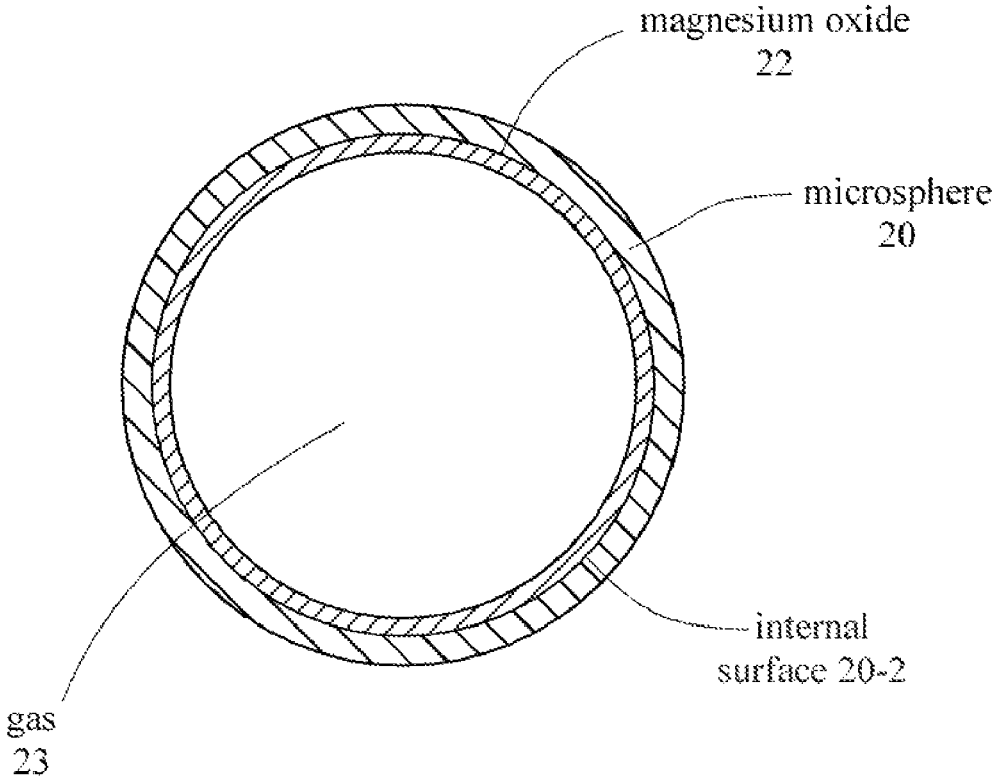
FIG. 6 shows a cross-section view of a plasma-shell embodiment.
Figure 7:
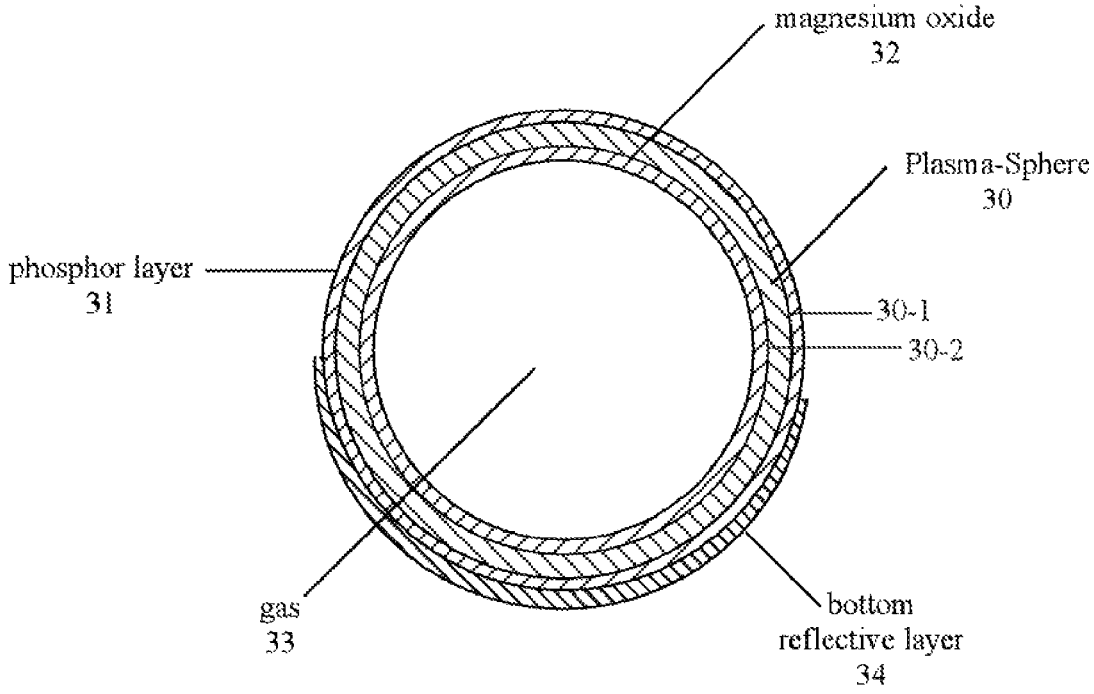
FIG. 7 shows a cross-section view of another plasma-shell embodiment.

The bottom substrate 11 contains electrodes 12, barriers 13 and phosphor 14R, 14G, 14B on the barriers 13. Each barrier 13 comprises a bottom portion 13A and a top portion 13B. The top barrier portion 13B is dark or black for increased contrast ratio. The bottom barrier portion 13A may be translucent, opaque, dark, or black. In one embodiment, the barriers 13 are made of a luminescent material and are excited by photons from the gas discharge within a plasma-shell 20. In another embodiment, both the barriers 13 and the plasma-shells 20 are made of or contain luminescent material. The plasma-shell 20 may be as shown in FIG. 6 or FIG. 7 hereof. The top substrate 15 is transparent material for viewing and contains y row scan electrode 18A and x bulk sustain electrode 18B in contact with plasma-shells 20.

Each electrode 12 on the bottom substrate 11 is called a column data electrode. The y electrode 18A on the top substrate 15 is the row scan electrode and the x electrode 18B on the top substrate 15 is the bulk sustain electrode. The gas discharge inside a plasma-shell 20 is initiated by voltages applied between a bottom column data electrode 12 and a top y row scan electrode 18A. The sustaining of the resulting discharge is between an electrode pair of the top y row scan electrode 18A and a top x bulk sustain electrode 18B. Each pair of the y and x electrodes is a row. The three-electrode system may be as disclosed in U.S. Pat. No. 5,661,500 (Shinoda et al.), incorporated herein by reference. In one embodiment, each plasma-shell 30 is in contact with only two electrodes as shown in FIGS. 1 and 2, such as the bottom electrode 12 in combination with one of the top electrodes 18A, or 18B. The two-electrode system is called the columnar discharge system, for example, as disclosed in U.S. Pat. No. 5,793,158 (Wedding), incorporated herein by reference.

Phosphor 14R emits red luminance when excited by photons from the gas discharge within the plasma-shell. Phosphor 14G emits green luminance when excited by photons from the gas discharge within a plasma-shell. Phosphor 14B emits blue luminance when excited by photons for the gas discharge within a plasma-shell. The phosphors may be selected from inorganic and/or organic luminescent substances including mixtures of luminescent substances. As noted above, the luminescent substance can be on or in the plasma-shell or on the barrier or both. The plasma-shell or barrier or both can be made of a luminescent material.

The row scan electrode 18A and the bulk sustain electrode 18B may each be a transparent material such as tin oxide or indium tin oxide (ITO) with a thin conductive ribbon or bus bar along one edge. The ribbon may be any conductive material including gold, silver, copper, aluminum, chrome-copper-chrome, or like metal or alloy.

The drive system for an AC plasma display includes electronic circuitry for applying write voltage pulses, erase voltage pulses, and sustain voltage pulses in a selectable fashion to one or more pixels or cells. A write pulse at a pixel cite causes the gas to discharge and emit light. An erase pulse causes the plasma to extinguish. A sustain pulse causes a pixel previously written to continue to emit light until subjected to an erase pulse.

A basic electronic architecture for applying voltages to the three electrodes 12, 18A, 18B is disclosed in U.S. Pat. Nos. 5,661,500 (Shinoda et al.), 5,674,553 (Shinoda et al.) and 5,446,344 (Kanazawa), incorporated herein by reference. This basic architecture is widely used in the PDP industry for addressing and sustaining AC gas discharge (plasma) displays and has been labeled by Fujitsu as ADS (Address Display Separately). In addition to ADS, other suitable architectures are known in the art and are available for addressing and sustaining the electrodes 12, 18A, and 18B of FIGS. 3 and 4 including Simultaneous Address and Sustain (SAS) described herein.

FIG. 4 is a variation of FIG. 3 and shows another embodiment of this invention comprising a plurality of plasma-shells 30 positioned in eggshell cavities, wells, or hollows 19. In this embodiment, the plasma-shell 30 of FIG. 7 is used in the plasma display structure of FIG. 4. However, the plasma-shell 30 of FIG. 6 may also be used.

The electrodes 12, 18A, and 18B are in contact with each plasma-shell so that a gas discharge results inside the plasma-shell. Although FIGS. 3, 4, and 5 are shown with a single row of plasma-shells in each channel or groove formed by the barriers 13, or hollows 19, there may be layers of plasma-shells randomly or selectively arranged in stacks in the channel or groove.

The geometric arrangement of the plasma-shells as illustrated in FIGS. 3 and 4 is red-green-blue (RGB). Other geometric arrangements of the phosphor may be utilized in the practice of this invention.

Figure 5:
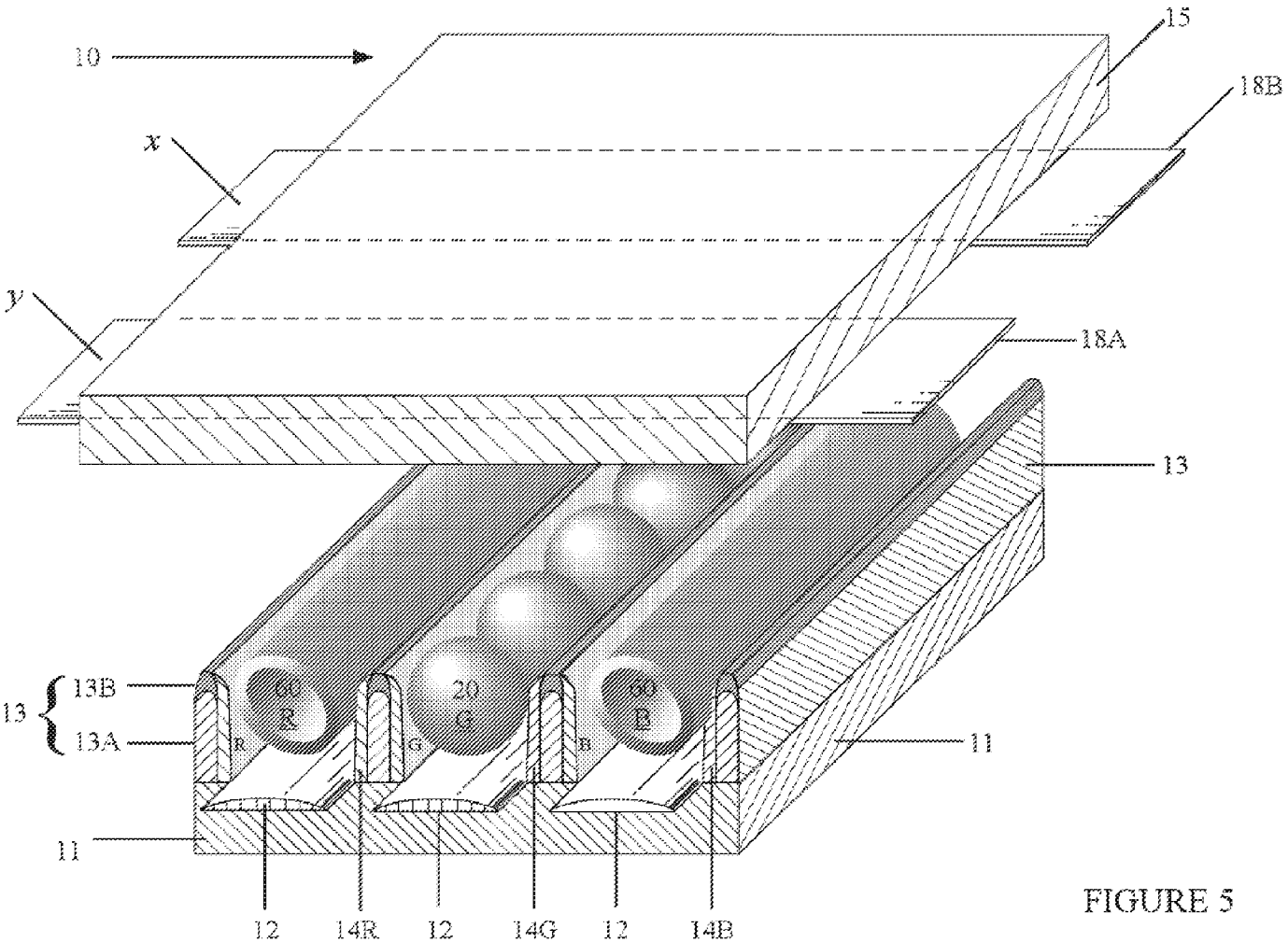
FIG. 5 shows a prospective view of an AC gas discharge (plasma) display panel with dual substrates and both gas-filled plasma-shells and elongated plasma-tubes.

FIG. 5 shows a dual substrate surface discharge with gas-filled plasma-shells 20G and gas-filled plasma-tubes 60R and 60B and corresponding phosphor 14R, 14G, and 14B. Plasma-shells and plasma-tubes of different geometric shapes may be used in combination with plasma-shells. The barriers shown in FIGS. 3, 4, and 5 may be made wholly or in part from a luminescent material such as a phosphor and excited by a gas discharge within a plasma-shell or plasma-tube.

FIG. 6 shows a cross-sectional view of a plasma-sphere or microsphere 20 with external surface 20-1 and internal surface 20-2, an internal magnesium oxide layer 22, and ionizable gas 23.

Magnesium oxide is a secondary electron emission substance which emits one or more secondary electrons when it is bombarded, struck, or impacted by another electron. Other secondary electron materials may be substituted for magnesium oxide or used in combination with magnesium oxide.

Magnesium oxide increases the ionization level through secondary electron emission that in turn leads to reduced gas discharge voltages. The thickness of the magnesium oxide is about 250 Angstrom Units to 10,000 Angstrom Units (Å).

Magnesium oxide is susceptible to contamination. To avoid contamination, conventional gas discharge (plasma) displays are generally assembled in clean rooms that are expensive to construct and maintain. In the conventional plasma panel production, magnesium oxide may be applied to an entire substrate surface. At this point the magnesium oxide is vulnerable to contamination. If the magnesium oxide layer 22 is on the inside surface 20B of the plasma-sphere 20, exposure of the magnesium oxide to contamination is minimized. The magnesium oxide layer 22 may be applied to the inside of the plasma-sphere 20 by using a process similar to the technique disclosed by U.S. Pat. No. 4,303,732 (Torobin). In this process, magnesium vapor is incorporated as part of the ionizable gases introduced into the plasma-sphere while the plasma-sphere is at an elevated temperature.

FIG. 7 shows a cross-sectional view of another embodiment of a microsphere or plasma-sphere 30 with external surface 30-1 and internal surface 30-2, an external phosphor layer 31, internal magnesium oxide layer 32, ionizable gas 33, and an external bottom reflective layer 34.

The phosphor 31 is selected to emit the desired visible or invisible wavelength of light, e.g. red, blue, or green in a multicolor plasma display. The phosphor may be a layer or coating over all or part of the external surface of the plasma-shell 30. The thickness of the phosphor ranges from about 2 to 40 microns, typically about 5 to 15 microns. The thickness may be optimized for each phosphor.

The bottom reflective layer 34 is optional and will typically cover about half of the phosphor layer 31 on the external surface 30A. This bottom reflective layer 34 will reflect light upward that would otherwise escape and increase the brightness of the display.

Figure 8:
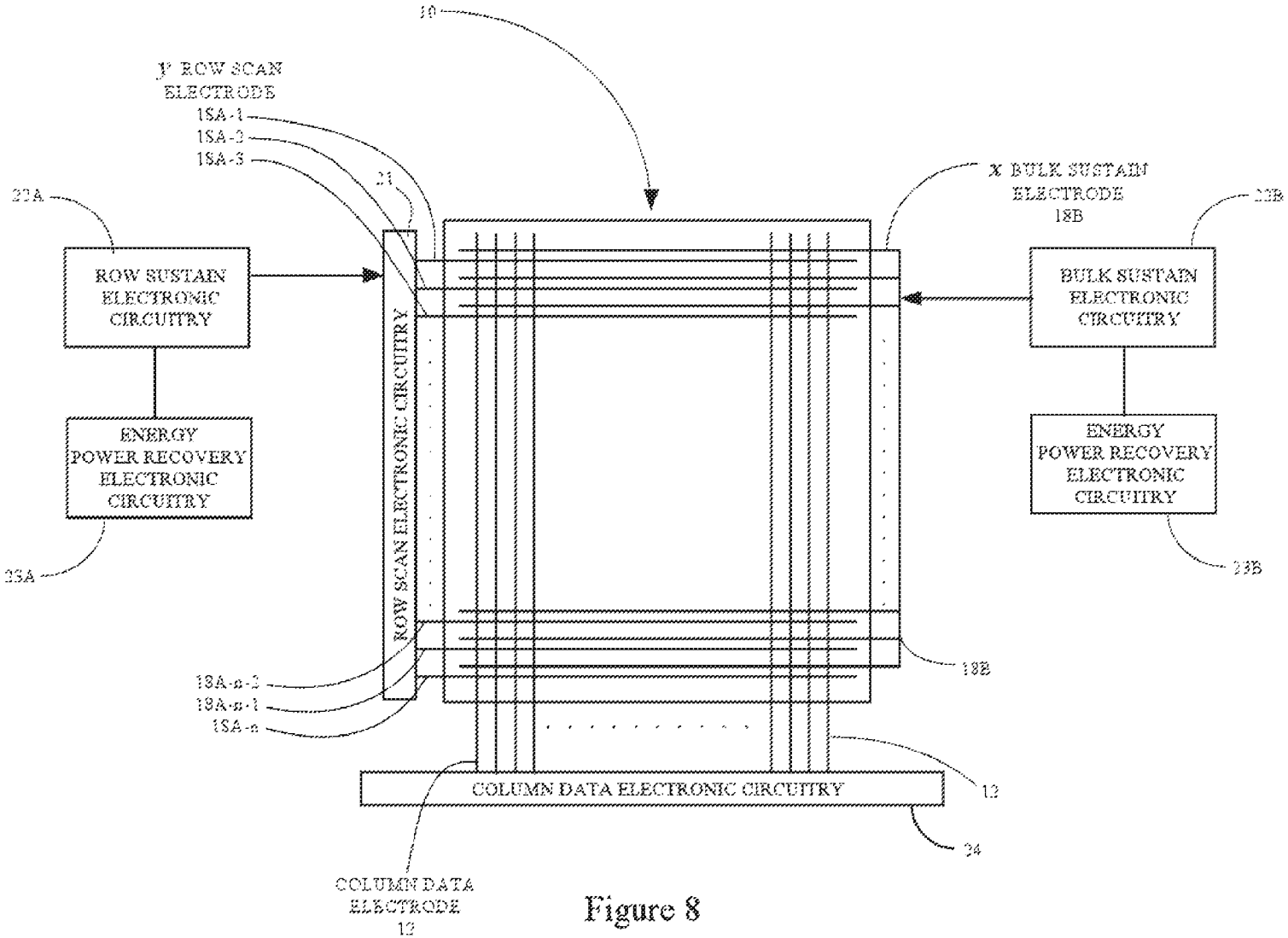
FIG. 8 shows a block diagram of electronics for driving an AC gas discharge plasma display.

FIG. 8 shows display panel 10 with electronic circuitry 21 for the y row scan electrodes 18A-1, 18A-2, 18A-3, 18A-n, 18A-n-1, 18A-n-2, etc. bulk sustain electronic circuitry 22B for x bulk sustain electrode 18B and column data electronic circuitry 24 for the column data electrodes 12. There is also shown row sustain electronic circuitry 22A with an energy power recovery electronic circuit 23A. There is also shown energy power recovery electronic circuitry 23B for the bulk sustain electronic circuitry 22B.

The energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), and 5,739,641 (Nakamura et al.).

Although FIGS. 1 to 7 illustrate a plasma-sphere or microsphere, there may be used plasma-shells of other geometric shapes or configurations including a plasma-disc or plasma-dome.

Figure 9A:
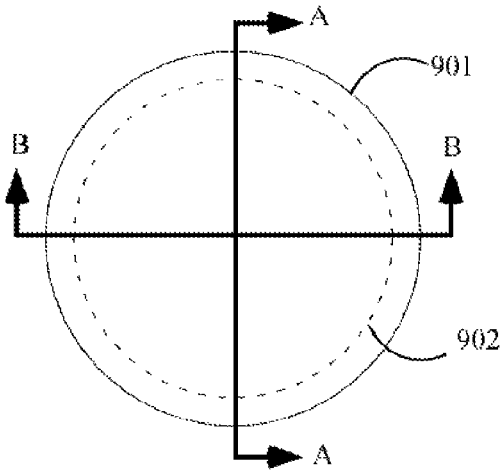
FIGS. 9A, 9B, and 9C show a plasma-dome with one flat side.
Figure 9B:
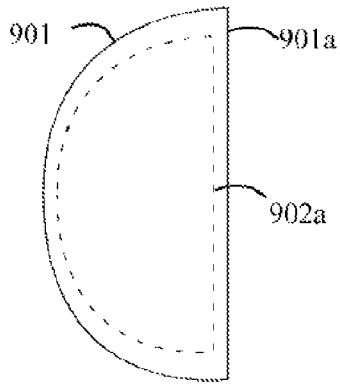
Figure 9C:
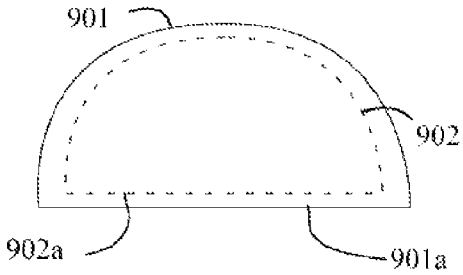

A plasma-dome is shown in FIGS. 9A, 9B, and 9C. FIG. 9A is a top view of a plasma-dome with an outer shell wall 901 and an inner shell wall 902. FIG. 9B is a section A-A view of FIG. 9A showing a flattened outer wall 901*a* and flattened inner wall 902*a*. FIG. 9C is a section B-B view of FIG. 9A.

Figure 10A:
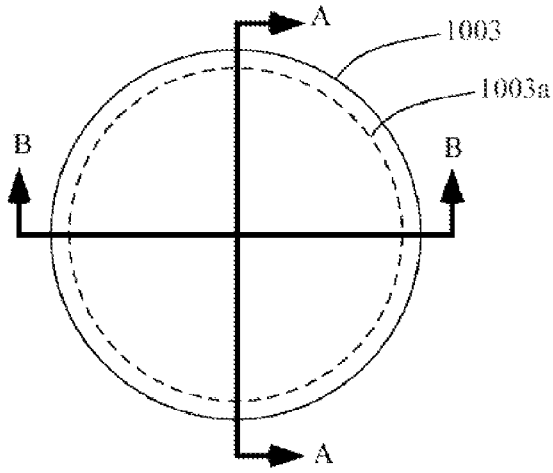
FIGS. 10A, 10B, and 10C show a plasma-disc with multiple flat sides.
Figure 10B:
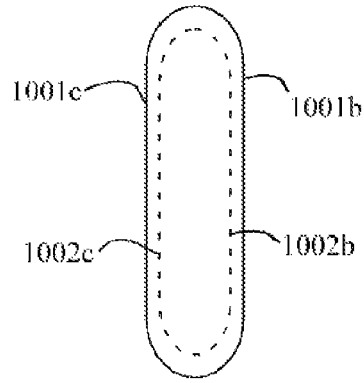
Figure 10C:
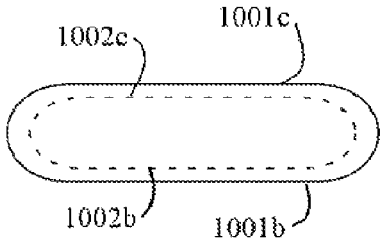

FIG. 10A is a top view of a plasma-disc with inner shell wall 1003*a* and outer shell wall 1003. FIG. 10B is a section A-A view of FIG. 10A showing flattened outer wall 1001*c* and 1001*b*, and flattened inner wall 1002*b* and 1002*c*. FIG. 10C is a section B-B view of FIG. 10A.

ADS

A basic electronics architecture for addressing and sustaining a surface discharge AC plasma display is called Address Display Separately (ADS). The ADS architecture may be used for a monochrome or multicolor display. The ADS architecture is disclosed in a number of Fujitsu patents including U.S. Pat. Nos. 5,541,618 (Shinoda) and 5,724,054, (Shinoda), incorporated herein by reference. Also see U.S. Pat. No. 5,446,344 (Kanazawa) and 5,661,500 (Shinoda et al.), incorporated herein by reference. ADS is a basic electronic architecture widely used in the AC plasma display industry for the manufacture of PDP monitors and television.

Fujitsu ADS architecture is commercially used by Fujitsu and is also widely used by competing manufacturers including Matsushita and others. ADS is disclosed in U.S. Pat. No. 5,745,086 (Weber), incorporated herein by reference. See FIGS. 2, 3, 11 of Weber '086. The ADS method of addressing and sustaining a surface discharge display as disclosed in U.S. Pat. Nos. 5,541,618 (Shinoda) and 5,724,054 (Shinoda), incorporated herein by reference, sustains the entire panel (all rows) after the addressing of the entire panel. The addressing and sustaining are done separately and are not done simultaneously. ADS may be used to address plasma-tubes alone or in combination with plasma-shells, including plasma-spheres, plasma-discs, or plasma-domes in a PDP.

ALIS

This invention may also use the shared electrode or electronic ALIS drive system disclosed by Fujitsu in U.S. Pat. Nos. 6,489,939 (Asso et al.), U.S. Pat. No. 6,498,593 (Fujimoto et al.), U.S. Pat. No. 6,531,819 (Nakahara et al.), U.S. Pat. No. 6,559,814 (Kanazawa et al.), U.S. Pat. No. 6,577,062 (Itokawa et al.), U.S. Pat. No. 6,603,446 (Kanazawa et al.), U.S. Pat. No. 6,630,790 (Kanazawa et al.), U.S. Pat. No. 6,636,188 (Kanazawa et al.), U.S. Pat. No. 6,667,579 (Kanazawa et al.), U.S. Pat. No. 6,667,728 (Kanazawa et al.), U.S. Pat. No. 6,703,792 (Kawada et al.), and U.S. Patent Application, Publication 2004/0046509 (Sakita), all of which are incorporated herein by reference. In accordance with this invention, ALIS may be used to address plasma-tubes alone or in combination with plasma-shells, including plasma-spheres, plasma-discs, and plasma-domes.

AWD

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. Nos. 3,801,861 (Petty et al.) and 3,803,449 (Schmersal), both incorporated herein by reference. FIGS. 1 and 3 of the Shinoda '054 ADS patent disclose AWD architecture as prior art. The AWD electronics architecture for addressing and sustaining monochrome PDP has also been adopted for addressing and sustaining multicolor PDP. For example, Samsung Display Devices Co., Ltd., has disclosed AWD and the superimpose of address pulses with the sustain pulse. Samsung specifically labels this as address while display (AWD). See "High-Luminance and High-Contrast HDTV PDP with Overlapping Driving Scheme", J. Ryeom et al., pages 743 to 746, Proceedings of the Sixth International Display Workshops, IDW 99, Dec. 1-3, 1999, Sendai, Japan and AWD as disclosed in U.S. Pat. No. 6,208,081 (Eo et al.), incorporated herein by reference. LG Electronics Inc. has disclosed a variation of AWD with a Multiple Addressing in a Single Sustain (MASS) in U.S. Pat. No. 6,198,476 (Hong et al.), incorporated herein by reference. Also see U.S. Pat. No. 5,914,563 (Lee et al.), incorporated herein by reference. AWD may be used to address plasma-tubes alone or in combination with plasma-shells, including plasma-spheres, plasma-discs, and plasma-domes.

An AC voltage refresh technique or architecture is disclosed by U.S. Pat. No. 3,958,151 (Yano et al.), incorporated herein by reference. In one embodiment of this invention the plasma-tubes alone or in combination with plasma-shells are filled with pure neon and operated with the architecture of Yano '151.

Energy Recovery

Energy recovery is used for the efficient operation of a PDP. Examples of energy recovery architecture and circuits are well known in the prior art. These include U.S. Pat. Nos. 4,772,884 (Weber et al.) 4,866,349 (Weber et al.), 5,081,400 (Weber et al.), 5,438,290 (Tanaka), 5,642,018 (Marcotte), 5,670,974 (Ohba et al.), 5,808,420 (Rilly et al.), and 5,828,353 (Kishi et al.), all incorporated herein by reference.

Ramp Waveforms

Ramp or slope waveforms may be used in the practice of this invention. The prior art discloses both fast and slow rise slopes and ramps for the addressing of AC plasma displays. The early patents disclosing fast and slow rise ramps or slopes include U.S. Pat. Nos. 4,063,131 (Miller), 4,087,805 (Miller), 4,087,807 (Miavecz), 4,611,203 (Criscimagna et al.), and 4,683,470 (Criscimagna et al.), all incorporated herein by reference.

Architecture for a ramp waveform address is disclosed in U.S. Pat. No. 5,745,086 (Weber), incorporated herein by reference. Weber '086 discloses positive or negative ramp voltages that exhibit a slope that is set to assure that current flow through each display pixel site remains in a positive resistance region of the gas discharge. The ramp architecture may be used in combination with ADS as disclosed in FIG. 11 of Weber '086. PCT Patent Application WO 00/30065, U.S. Pat. Nos. 6,738,033(Hibino et al.), and 6,900,598 (Hibino et al.), also disclose architecture for a ramp reset voltage and are incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Tokunaga et al. "Development of New Driving Method for AC PDPs,"*Proceedings of the Sixth International Display Workshops, IDW* 99, Sendai, Japan (Dec. 1-3, 1999): 787-790. Also see European Patent Application Publication EP 1 020 838 A1 (Tokunaga et al.). The CLEAR techniques disclosed in the above Pioneer IDW publication and Pioneer EP 1020838 A1, are incorporated herein by reference.

SAS

In one embodiment of this invention it is contemplated using SAS electronic architecture to address a PDP panel constructed of plasma-tubes alone or in combination with plasma-shells, including plasma-spheres, plasma-discs, and/or plasma-domes. SAS architecture comprises addressing one display section of a surface discharge PDP while another section of the PDP is being simultaneously sustained. This architecture is called Simultaneous Address and Sustain (SAS). See U.S. Pat. No. 6,985,125, incorporated herein by reference. SAS offers a unique electronic architecture, which is different from prior art columnar discharge and surface discharge electronics architectures including ADS, AWD, and MASS. It offers important advantages as discussed herein. In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining. An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y. In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_i$ of the PDP while a sustaining voltage is being simultaneously applied to at least one other section $S_2$ of the PDP. In another embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x-electrodes. In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained. In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" -for the various subfields. A gray scale image is realized by integrating in time the various "on" and "off" pixels of each of the subfields. Addressing is the selective application of data to individual pixels. It includes the writing or erasing of individual pixels. Reset is a voltage pulse, which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield. In accordance with another embodiment of the SAS architecture, there is applied a slow rise time or slow ramp reset voltage as disclosed in U.S. Pat. No. 5,745,086 (Weber) cited above and incorporated herein by reference. As used herein slow rise time or slow ramp voltage is a bulk address commonly called a reset pulse with a positive or negative slope so as to provide a uniform wall charge at all pixels in the PDP. The slower the rise time of the reset ramp, the less visible the light or background glow from those off-pixels (not in the on-state) during the slow ramp bulk address. Less background glow is particularly desirable for increasing the contrast ratio, which is inversely proportional to the light-output from the off-pixels during the reset pulse. Those off-pixels, which are not in the on-state, will give a background glow during the reset. The slower the ramp, the less light output with a resulting higher contrast ratio. Typically the slow ramp reset voltages disclosed in the prior art have a slope of about 3.5 volts per microsecond with a range of about 2 to about 9 volts per microsecond. In the SAS architecture, it is possible to use slow ramp reset voltages below 2 volts per microsecond, for example about 1 to 1.5 volts per microsecond without decreasing the number of PDP rows, without decreasing the number of sustain pulses or without decreasing the number of subfields.

Plasma-Shell Materials

The plasma-shell may be constructed of any suitable material including glass, ceramic, plastic, metal, metalloids, and so forth. In the practice of this invention, it is contemplated that the plasma-shell may be made of any suitable inorganic compounds of metals and/or metalloids, including mixtures or combinations thereof. Contemplated inorganic compounds include the oxides, carbides, nitrides, nitrates, silicates, silicides, aluminates, phosphates, sulphates, sulfides, borates, and borides.

The metals and/or metalloids are selected from lithium, sodium, potassium, rubidium, cesium, magnesium, calcium, strontium, barium, scandium, yttrium, lanthanum, cerium, praseodymium, neodymium, promethium, samarium, europium, gadolinium, terbium, erbium, actinium, thorium, protactinium, uranium, neptunium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, copper, silver, zinc, cadmium, boron, aluminum, gallium, indium, thallium, carbon, silicon, germanium, tin, lead, phosphorus, arsenic, antimony and bismuth.

Inorganic materials suitable for use are magnesium oxide (s), aluminum oxide(s), zirconium oxide(s), and silicon carbide(s) such as MgO, $Al_2O_3$, $ZrO_2$, $SiO_2$, and/or SiC.

In one embodiment, the shell is composed wholly or in part of one or more borides of one or more members of Group IIIB of the Periodic Table and/or the rare earths including both the Lanthanide Series and the Actinide Series of the Periodic Table.

Contemplated Group IIIB borides include scandium boride and yttrium boride. Contemplated rare earth borides of the Lanthanides and Actinides include lanthanum boride, cerium boride, praseodymium boride, neodymium boride, gadolinium boride, terbium boride, actinium boride, and thorium boride.

In one embodiment, the shell is composed wholly or in part of one or more Group IIIB and/or rare earth hexaborides with the Group IIIB and/or rare earth element being one or more members selected from Sc, Y, La, Ce, Pr, Nd, Sm, Eu, Gd, Tb, Dy, Ho, Yb, Ac, Th, Pa, and U. Examples include lanthanum hexaboride, cerium hexaboride, and gadolinium hexaboride.

Rare earth borides, including rare earth hexaboride compounds, and methods of preparation are disclosed in the following prior art, incorporated herein by reference: U.S. Pat. Nos. 3,258,316 (Tepper et al.), 3,784,677 (Versteeg et al.), 4,030,963 (Gibson et al.), 4,260,525 (Olsen et al.), 4,999,176 (Iltis et al.), 5,238,527 (Otani et al.), 5,336,362 (Tanaka et al.), 5,837,165 (Otani et al.), and 6,027,670 (Otani et al.).

Group IIA alkaline earth borides are contemplated including borides of Mg, Ca, Ba, and Sr. In one embodiment, there is used a material containing trivalent rare earths and/or trivalent metals such as La, Ti, V, Cr, Al, Ga, and so forth having crystalline structure similar to the perovskite structure, for example as disclosed in U.S. Pat. No. 3,386,919 (Forrat), incorporated herein by reference.

The shell may also be composed of or contain carbides, borides, nitrides, silicides, sulfides, oxides and other compounds of metals and/or metalloids of Groups IV and V as disclosed and prepared in U.S. Pat. No. 3,979,500 (Sheppard et al.), incorporated herein by reference. Compounds including borides of Group IVB metals such as titanium, zirconium, and hafnium and Group VB metals such as vanadium, niobium, and tantalum are contemplated.

In one embodiment of this invention, the plasma-shell is made of fused particles of glass, ceramic, glass ceramic, refractory, fused silica, quartz, or like amorphous and/or crystalline materials including mixtures of such. In one embodiment, a ceramic material is selected based on its transmissivity to light after firing. This may include selecting ceramic material with various optical cutoff frequencies to produce various colors. One material contemplated for this application is aluminum oxide. Aluminum oxide is transmissive from the UV range to the IR range. Because it is transmissive in the UV range, luminescent materials such as phosphors excited by UV may be applied to the exterior of an aluminum oxide to produce various colors. The application of the phosphor to the exterior of the plasma-shell may be executed by any suitable means before or after the plasma-shell is positioned in the PDP. There may be several layers or coatings of phosphors, each of a different composition, applied to the exterior of the plasma-shell.

In one specific embodiment of this invention, the plasma-shell is made of an aluminate silicate or contains a layer of aluminate silicate. When the ionizable gas mixture contains helium, the aluminate silicate is especially beneficial in preventing the escape of helium. It is also contemplated that the plasma-shell may be made of lead silicates, lead phosphates, lead oxides, borosilicates, alkali silicates, aluminum oxides, and pure vitreous silica.

The plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, silicides, aluminates, phosphates, sulphates, sulfides, borates, borides, and other inorganic compounds of the above and other elements.

The plasma-shell may also contain or be partially or wholly constructed of luminescent materials such as inorganic and/or organic phosphor(s). The phosphor may be a continuous or discontinuous layer or coating of inorganic and/or organic substance on the interior or exterior of the shell. Inorganic and/or organic luminescent particles may also be introduced inside the plasma-shell or embedded within the shell. Inorganic and/or organic luminescent quantum dots may also be incorporated into the shell.

DC Plasma Memory Mode

The DC plasma memory mode operation of plasma-shells may be provided with resistor elements in series with the electronic drive circuits to provide the memory functionality. In one embodiment, the plasma-shell itself is made of materials that provide both appropriate resistance in series with the electronic circuits as well as electrical isolation between circuits. In another embodiment, the plasma-shell is comprised of both resistive material segments and insulating material segments that isolate resistive electrode members from one another. In another embodiment, portions of an insulating shell may be made into resistive electrode islands by locally diffusing conductive material into the insulating shell material. In another embodiment, conductive electrode elements may penetrate an insulating shell and the resistor is formed on the external surface of the shell. Resistive elements may also be provided elsewhere in the circuit external to the shell. U.S. Pat. No. 4,297,613 (Aboelfotoh) describes the use of external resistors.

A series circuit resistor provides plasma memory functionality by providing a voltage drop across the shell and creating an internal voltage across the gas that is somewhat lower than the externally applied voltage once the gas is ionized. For example, a plasma-shell may require a 200-volt ignition potential to turn ON a plasma discharge. An externally applied voltage waveform in excess of the required 200-volt ignition (gas discharge) voltage may be applied to the plasma-shell to cause gas discharge (ON state). After ignition, the externally applied voltage is reduced to below the 200-volt ignition value, i.e. 150 volts, to sustain the plasma-shell gas discharge in the ON state. Once the gas discharge current is flowing, the internal voltage within the plasma-shell will be redistributed due to the voltage drop across the resistor through which the discharge current is flowing. If the externally applied voltage across the plasma-shell is maintained at 150 volts, and the voltage drop across the resistor is 50 volts, the internal voltage drop across the ionizable gas will be 100 volts. In this mode, the gas discharge within the plasma-shell will continue as long as the externally applied voltage remains above the extinction level, 100 volts in this example. If the externally applied voltage temporarily falls below the extinction level, the gas discharge will be turned off and remain off. As long as the externally applied voltage does not exceed the ignition voltage, the gas discharge will be maintained in an OFF memory state. The plasma-shell gas discharge may be returned to the ON memory state when the externally applied voltage again exceeds the ignition voltage. Thus, an array of plasma-shells operating as a display device would have an operating voltage window of 100 volts, the difference between ignition voltage of 200 volts and the extinction voltage of 100 volts that is common to all of the plasma-shells in the array. Accordingly the ON and OFF states of any plasma-shell within the array may be independently controlled in memory mode. Once turned on, plasma-shell gas discharge may be sustained in the ON state as long as the externally applied voltage remains within the common voltage operating window; and plasma-shell gas discharge will be sustained in the OFF state when the voltage drops below the extinction level until the external voltage again exceeds the ignition voltage.

Sheet Resistance

A DC PDP shell may be made of a material having a sheet resistance to prevent or minimize electrical contact between electrodes connected to the shell. This may also enhance the operation of a DC PDP in the memory mode.

Sheet resistance is a measure of the resistance of the shell in a direction perpendicular to thickness, that is, in a direction around the surface of the shell. The term is commonly used in the semiconductor industry, for example, to evaluate semiconductor doping, metal deposition, and resistive paste printing. Sheet resistance is disclosed in U.S. Pat. Nos. 4,212,020 (Yariv et al.) and 6,657,439 (Harada), both incorporated herein by reference. A 4-point probe is generally used to measure sheet resistance. The volume of a sphere is $\frac{4}{3}\pi r^3$ where r is the sphere radius. To obtain the shell thickness t of a hollow sphere with an inside radius $r_i$ and an outside radius $r_o$:

$$t=\tfrac{4}{3}\pi r_o^3-\tfrac{4}{3}\pi r_i^3$$

$$t=\tfrac{4}{3}\pi(r_o^3-r_i^3)$$

As used herein, sheet resistance is the resistance of the sphere shell thickness t around the sphere.

Conductive Plasma-Shell

The plasma-shell, especially in a DC PDP, may be made, wholly or in part, of a conductive material, for example, as disclosed in the prior art discussed herein below and incorporated by reference. The shell can comprise conductive materials particularly metals or metalloid oxides, e.g. as used for electrodes, especially the cathode. The following can be used for the shell and/or electrodes in a DC PDP.

U.S. Pat. No. 6,797,662 (Jaffrey) discloses electrically conductive ceramics. A metal oxide ceramic material such as alumina may be is rendered electrically conductive through its thickness by the incorporation of silver into the material.

U.S. Pat. No. 6,631,062 (Minamisawa et al.) discloses an electrically conductive ceramic material and a process of producing same. The material comprises a compound containing at least one element belonging to the Group IIIA of the Periodic Table and $TiO_{2-x}$ where (0<x<2) is in a range such that the $TiO_{2-x}$ (0<x<2) accounts for 1% to 60% by weight of the total amount of the ceramics, and at least part of the compound and the $TiO_{2-x}$ form a composite oxide.

U.S. Pat. No. 6,531,408 (Iwata et al.) discloses a method for growing zinc oxide based semi-conductor layers. U.S. Pat. No. 6,146,552 (Iga et al.) discloses a method for producing zinc oxide for low and high voltages. U.S. Pat. Nos. 5,770,113 (Iga et al.) and 5,739,742 (Iga et al.) disclose zinc oxide compositions including methods of preparation.

U.S. Pat. No. 5,795,502 (Terashi et al.) discloses electrically conducting ceramics and/or process for producing the same. The electrically conducting ceramics have as a chief crystalline phase a perovskite crystalline phase containing La, Cr and Mg and also having, in addition to the chief crystalline phase, an oxide phase containing La. The ceramics are dense, exhibit excellent sintering properties at low temperatures, have high electrical conductivity, and remain stable in a reducing atmosphere.

U.S. Pat. Nos. 5,656,203 (Mikesha) and 5,601,853 (Bednarz et al.) disclose electrically conductive ceramics with oxides of Al, Cr, and Mg such as alumina, chromia, and magnesia. Ceramics are disclosed which exhibit volume resistivities of 1012 ohm-cm or less at 20° C. and have excellent electrical stability and superior mechanical properties.

U.S. Pat. No. 5,604,048 (Nishihara et al.) discloses an electrically conducting ceramic having improved electrical conductivity, which comprises a perovskite-type composite oxide. U.S. Pat. No. 5,688,731 (Chatterjee et al.) discloses a ceramic composite containing doped zirconia having high electrical conductivity. These electrically conductive ceramics comprise tetragonal zirconia or a composite of zirconia-alumina and zirconium diboride. U.S. Pat. No. 5,397,920 (Tran) discloses light transmissive electrically conductive compositions including methods of preparation. U.S. Pat. No. 5,126,218 (Clarke) discloses a conductive ceramic substrate for batteries formed from a sub-stiochemetric titanium dioxide material. The disclosed preferred material is $TiO_x$, where x is in the region of 1.55 to 1.95.

U.S. Pat. No. 5,066,423 (Kubo et al.) discloses a conductive ceramic sintered body substantially free from large variation of electric resistivity, which consists essentially of: (a) a silicon nitride-base ceramic as a matrix; (b) 10% to 70% volume of a first conductive material which consists of one or more conductive compounds selected from carbides, nitrides, oxides and their composite compounds of transition metals in Groups IVA, VA and VIA of the Periodic Table; and (c) 0.1% to 50% volume of a second conductive material consisting of SiC; the first conductive material and the second conductive material serving to form paths for electric conduction. U.S. Pat. No. 4,795,723 (Nishikawa et al.) discloses an electrically conductive hot press sintered ceramic comprising boron nitride, titanium diboride and aluminum nitride and having a flexural strength of at least 900 kg/cm$^2$ with a specific resistance of 300 to 2,500 micro ohm-centimeter (μΩ-cm). U.S. Pat. No. 4,645,622 (Keck) discloses an electrically conductive ceramic having the composition $La_xCa_yMnO_3$ where x is 0.44 to 0.48, y is 0.42 to 0.50 and the sum of the mol numbers of La and Ca is between 1% to 15% (preferably about 10%) and smaller than the mol number of Mn.

U.S. Pat. No. 4,113,928 (Virkar et al.) discloses the preparation of dense, high strength, and electrically conductive ceramics containing β"-alumina. There is prepared a dense and strong polycrystalline β"-alumina-containing ceramic body exhibiting an electrical resistivity for sodium ion conduction at 300° C. of 9 ohm-cm or lower obtained directly after sintering and having a controlled fine microstructure exhibiting a uniform grain size under 50 micrometers. The reference discloses methods of uniformly distributing selected metal ions having a valence not greater than 2, e.g. lithium or magnesium, uniformly throughout the beta-type alumina composition prior to sintering to form β"-alumina. This uniform distribution allows more complete conversion of β-alumina to β-alumina during sintering. As a result, the polycrystalline IV-alumina containing ceramic bodies obtained by these methods exhibit high density, low porosity, high strength, fine grain size (i.e. no grains over 25-50 micrometers with an average size under 5-10 micrometers), low electrical resistivity and a high resistance to degradation by water vapor in an ambient atmosphere.

Secondary Electron Emission

Secondary electron emission (Townsend coefficient) materials may be incorporated into the plasma-shell. Such may be used in electrodes in a DC PDP.

The use of secondary electron emission materials in a plasma display is known in the prior art and is disclosed in U.S. Pat. No. 3,716,742 (Nakayama et al.) incorporated herein by reference. The use of Group IIA compounds including magnesium oxide is disclosed in U.S. Pat. Nos. 3,836,393 and 3,846,171 incorporated herein by reference. The use of rare earth compounds in an AC plasma display is disclosed in U.S. Pat. Nos. 4,126,807, 4,126,809, and 4,494,038, all issued to Donald K. Wedding et al., and incorporated herein by reference. Lead oxide may also be used as a secondary electron material. Mixtures of secondary electron emission materials may be used.

In one embodiment and mode contemplated for the practice of this invention, a secondary electron emission material such as magnesium oxide is applied to part or all of the internal surface of a plasma-shell and/or to the electrodes, especially the cathode. The secondary electron emission material may also be on the external surface. The thickness of the magnesium oxide may range from about 250 Angstrom Units to about 20,000 Angstrom Units (Å) or more. The plasma-shell may be partially or completely made of a secondary electronic materials such as magnesium oxide and/or rare earth oxides. A secondary electron material may also be dispersed or suspended as particles within the ionizable gas such as with a fluidized bed. Phosphor particles may also be dispersed or suspended in the gas such as with a fluidized bed, and may also be added to the internal or external surface of the plasma-shell.

Magnesium oxide increases the ionization level through secondary electron emission that in turn leads to reduced gas discharge voltages. In one embodiment, the magnesium oxide is on the internal surface of the plasma-shell and the phosphor is located on an external surface of the plasma-shell. Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a plasma-shell minimizes exposure of the magnesium oxide to contamination. The magnesium oxide may be applied to the inside of the plasma-shell by incorporating magnesium vapor as part of the ionizable gas or gases introduced into the plasma-shell while the plasma-shell is at an elevated temperature. This may be done with a fluidized bed or other means. The magnesium, rare earth, or other metal or metalloid, may be oxidized while at an elevated temperature. In one embodiment, the rare earth, or other metal or metalloid is introduced into the gas or gasses and is oxidized in situ while in the gas or inside the plasma-shell.

Contemplated secondary electron emission materials also include borides and other compounds listed above for the shell materials especially the rare earth hexaborides such as lanthanum hexaboride ($LaB_6$), gadolinium hexaboride ($GaB_6$), and cerium hexaboride ($CeB_6$). These and other secondary electron emission materials including magnesium oxide can be applied to an electrode, for example as disclosed in U.S. Pat. No. 7,145,612 (Sakai et al.). The rare earth hexaborides are disclosed as good electron-emitting materials in U.S. Pat. No. 5,837,165 (Otami et al.), incorporated herein by reference. Also such materials are disclosed by Wedding '807, '809, and '038 cited above.

Ionizable Gas

The hollow plasma-shell as used in the practice of this invention contains one or more ionizable gas components. In the practice of this invention, the gas is selected to emit photons in the visible, IR, and/or UV spectrum.

The UV spectrum is divided into regions. The near UV region is a spectrum ranging from about 340 to 450 nm (nanometers). The mid or deep UV region is a spectrum ranging from about 225 to 340 nm. The vacuum UV region is a spectrum ranging from about 100 to 225 nm. The PDP prior art has used vacuum UV to excite photoluminescent phosphors. In one embodiment of this invention, it is contemplated using a gas that provide UV over the entire spectrum ranging from about 100 to about 450 nm. A PDP operates with greater efficiency at the higher range of the UV spectrum, such as in the mid UV and/or near UV spectrum. In one preferred embodiment, there is selected a gas that emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, and isotopes of oxygen such as oxygen-18. Other isotopes include deuterated gases such as deuterated ammonia ($ND_3$) and deuterated silane ($SiD_4$). A radioactive gas such as radon may be used in some applications alone or in combination with other gases.

In one embodiment, a two-component gas mixture (or composition) is used such as a mixture of neon and argon, neon and xenon, neon and helium, neon and krypton, neon and radon, argon and xenon, argon and krypton, argon and helium, argon and radon, xenon and krypton, xenon and helium, xenon and radon, krypton and helium, krypton and radon, and helium and radon. Specific two-component gas mixtures (compositions) include about 5% to 90% atoms of argon with the balance xenon. Another two-component gas mixture is a mother gas of neon containing 0.05% to 15% atoms of xenon, argon, and/or krypton. This can also be a three-component gas, four-component gas, or five-component gas by using quantities of an additional gas or gases selected from xenon, argon, krypton, and/or helium. In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon, krypton-neon-xenon, and krypton-helium-xenon for example as disclosed in U.S. Pat. Nos. 5,510,678 (Sakai et al.) and 5,559,403 (Sakai et al.), both incorporated herein by reference.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton. In one embodiment, there is used a high concentration of helium with the balance selected from one or more gases of neon, argon, xenon, and nitrogen as disclosed in U.S. Pat. No. 6,285,129 (Park) incorporated herein by reference. Mercury may also be added to the rare gases as disclosed in U.S. Pat. No. 4,041,345 (Sahni), incorporated herein by reference.

A high concentration of xenon may also be used with one or more other gases as disclosed in U.S. Pat. No. 5,770,921 (Aoki et al.), incorporated herein by reference. Pure neon may be used and the plasma-shells operated using the architecture disclosed by U.S. Pat. No. 3,958,151 (Yano) discussed above and incorporated herein by reference.

Excimers

Excimer gases may also be used as disclosed in U.S. Pat. Nos. 4,549,109 (Nighan et al.) and 4,703,229 (Nighan et al.), both incorporated herein by reference. Nighan et al. '109 and '229 disclose the use of excimer gases formed by the combination of halides with inert gases. The halides include fluorine, chlorine, bromine and iodine. The inert gases include helium, xenon, argon, neon, krypton and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. In addition to displays, other applications include devices for detecting radiation or antenna applications including radar transmissions. Such other gases include $C_2H_2$—$CF_4$—Ar mixtures as disclosed in U.S. Pat. Nos. 4,201,692 (Christophorou et al.) and 4,309,307 (Christophorou et al.), both incorporated herein by reference. Also contemplated are gases disclosed in U.S. Pat. No. 4,553,062 (Ballon et al.), incorporated herein by reference. Other gases include sulfur hexafluoride, HF, $H_2S$, $SO_2$, SO, $H_2O_2$, and so forth.

Gas Pressure

This invention allows the construction and operation of a gas discharge (plasma) display with higher gas pressures including pressures at or above one atmosphere. Increased gas pressures can extend life. Thus, a 10% increase in gas pressure can double display life. In the prior art, gas discharge (plasma) displays are operated with the ionizable gas at pressures below atmospheric. Gas pressures above atmospheric are not used in the prior art because of structural problems. Higher gas pressures above atmospheric may cause the display substrates to separate, especially at elevations of 4000 feet or more above sea level.

In the practice of this invention, the gas pressure inside of the hollow plasma-shell may be equal to or less than atmospheric pressure or may be equal to or greater than atmospheric pressure. In one embodiment of this invention, the gas pressure inside of the plasma-shell is equal to or less than atmospheric, about 100 to 760 Torr, typically about 350 to about 650 Torr. In another embodiment of this invention, the gas pressure inside of the plasma-shell is equal to or greater than atmospheric. Depending upon the structural strength of the plasma-shell, the pressure above atmospheric may be about 1 to 250 atmospheres (about 760 to 190,000 Torr) or greater. Higher gas pressures increase the luminous efficiency of the plasma display. The gas pressure is selected to allow efficient ionization. In one embodiment, the gas pressure is selected to allow the gas to ionize when a low voltage is applied.

Gas Processing

This invention avoids the costly prior art gas filling techniques used in the manufacture of gas discharge (plasma) display devices. The prior art introduces gas through one or more apertures into the device. This device requires a gas injection hole and tube. The prior art manufacturing processes typically include heating and baking out the assembled device (before gas fill) at a highly elevated temperature under vacuum for 2 to 12 hours. The vacuum is obtained via external suction through a tube inserted in an aperture. The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches diagonal, the bake out and vacuum cycle may be 10 to 30 hours per panel or 10 to 30 million hours per year for a manufacturing facility producing over one million plasma display panels per year.

The gas-filled plasma-shells used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, the plasma-shells are located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), 4,446,402 (Dick), 4,638,218 (Shinoda), all cited above and incorporated herein by reference. The plasma-shells may be positioned on the surface of the substrate and/or positioned in openings or depressions in the substrate such as in channels, trenches, grooves, wells, cavities, hollows, holes and so forth. These channels, trenches, grooves, wells, cavities, hollows, holes, etc., may extend through the substrate so that the plasma-shells positioned therein may be viewed from either side of the substrate.

The plasma-shells may also be positioned on or within a substrate of a dual substrate plasma display structure. Each plasma-shell is placed inside of a gas discharge (plasma) display device, for example, on the substrate along the channels, trenches or grooves between the barrier walls of a plasma display barrier structure such as disclosed in U.S. Pat. Nos. 5,661,500 (Shinoda et al.), 5,674,553 (Shinoda et al.), 4,737,687 (Shinoda et al.), 7,176,628 (Wedding), 7,157,854 (Wedding), 7,122,961 (Wedding), and 5,793,158 (Wedding), cited above and incorporated herein by reference. The plasma-shells may also be positioned within a substrate depression, such as a cavity, well, hollow, concavity, or saddle in the surface of a plasma display substrate, for example a substrate depression as disclosed by U.S. Pat. No. 4,827,186 (Knauer et al.), incorporated herein by reference.

In a device as disclosed by Wedding '158 or Shinoda et al. '500, the plasma-shells may be conveniently added to the substrate cavities and the space between opposing electrodes before the device is sealed. If two opposing substrates are used, an aperture and tube can be used for bake out of any space not occupied by the plasma-shell between the two opposing substrates, but the costly gas fill operation is eliminated.

Plasma displays of 40 inches in diagonal or larger are fragile with risk of breakage during shipment and handling The presence of the plasma-shells inside of the display device adds structural support and integrity to the device.

The plasma-shells may be sprayed, stamped, pressed, poured, screen-printed, or otherwise applied to the substrate. The substrate surface may contain an adhesive or sticky surface to bind the plasma-shell to the substrate. Typically the substrate has flat surfaces. However, the practice of this invention is not limited to a flat surface display. The plasma-shell may be positioned or located on a conformal surface or substrate so as to conform to a predetermined shape such as a curved or irregular surface.

In one embodiment of this invention, each plasma-shell is positioned within a cavity on a single substrate or monolithic gas discharge structure that has a flexible or bendable substrate. This allows the display to be bent in any direction, for example, the X and/or Y-axis, and the rolling up of the display like a rug. In another embodiment, the substrate is rigid. The substrate may also be semi-flexible. The plasma-shell may be positioned with either a flat side or a domed side in contact with the substrate.

Substrate

In accordance with various embodiments of this invention, the PDP may be comprised of a single substrate or dual (coplanar) substrate device with flexible, semi-flexible or rigid substrates. The substrate surface may be flat, curved or irregular. The substrate may be opaque, transparent, or translucent. In some embodiments, there may be used multiple substrates of three or more. Substrates may be flexible or bendable films, such as a polymeric film substrate. The flexible substrate may also be made of metallic materials alone or incorporated into a polymeric substrate. Alternatively, or in addition, the substrate may be made of an optically transparent thermoplastic polymeric material. Examples of polymeric materials include polycarbonate, polyvinyl chloride, polystyrene, polymethyl methacrylate, polyurethane polyimide, polyester, and cyclic polyolefin polymers. More broadly, the substrate may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication 2004/0179145 (Jacobsen et al.), incorporated herein by reference.

Alternatively, a substrate may be made of a rigid material. For example, a substrate may be glass with a flat, curved, or irregular surface. The glass may be a conventionally available glass, for example, having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm.

Each substrate may comprise single layer or multiple layers of the same or different materials. Substrate composites such as mixtures, dispersions, suspensions, and so forth are also contemplated.

Further details regarding substrates and substrate materials may be found in International Publications Nos. WO 00/46854, WO 00/49421, WO 00/49658, WO 00/55915, and WO 00/55916, the entire disclosures of which are incorporated herein by reference. Apparatus, methods, and compositions for producing flexible substrates are disclosed in U.S. Pat. Nos. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Positioning of a Plasma-Shell on the Substrate

The plasma-shell may be positioned or located in contact with the substrate by any appropriate means. Either a flat side or a domed side may be in contact with the substrate. In one embodiment of this invention, the plasma-shell is bonded or attached to the substrate surface of a monolithic or dual-substrate display. The plasma-shell may be bonded to the substrate surface with a non-conductive adhesive material, which also serves as an insulating barrier to prevent electrically shorting of the conductors or electrodes connected to a plasma-shell.

The plasma-shell may be mounted or positioned within a substrate well, cavity, hollow, hole, channel, trench, groove, or like depression or opening. The depression or opening is of suitable dimensions with a mean or average diameter and depth for receiving and retaining the plasma-shell. As used herein, depression includes opening, well, cavity, hollow, hole, channel, trench, groove, or any similar opening or depression configuration. In U.S. Pat. No. 4,827,186 (Knauer et al.) incorporated herein by reference, there is shown a cavity referred to as a concavity or saddle. The depression, well or cavity may extend partly through the substrate, embedded within, or extend entirely through the substrate. The cavity may comprise an elongated channel, trench, or groove extending partially or completely across the substrate.

The conductors or electrodes must be in electrical contact with each plasma-shell. An air gap between an electrode and the plasma-shell will increase operating voltages. A material such as a conductive adhesive and/or conductive filler may be used to bridge or connect the electrode to the plasma-shell. Such conductive material must be carefully applied so as not to electrically short the electrode to other nearby electrodes. A dielectric material may also be applied to fill any air gap. This dielectric material may also be an adhesive.

Insulating Barrier

An insulating barrier may be used to electrically separate the plasma-shells. It may also be used to bond each plasma-shell to the substrate. The insulating barrier may comprise any suitable non-conductive material, which bonds the plasma-shell to the substrate. In one embodiment, there is used an epoxy resin that is the reaction product of epichlorohydrin and bisphenol-A. One such epoxy resin is a liquid epoxy resin, D.E.R. 383, produced by the Dow Plastics Group of the Dow Chemical Company.

Optical Cross-Talk/Contrast

Opaque, translucent, or non-transparent material may be located between the plasma-shells to prevent optical cross-talk and/or improve contrast between plasma-shells, particularly between adjacent plasma-shells. A black material such as a black pigment or black filler may be located between plasma-shells. The black materials include black iron oxide, mica, ceramic black, graphite and other such materials known in the art, for example U.S. Pat. No. 4,320,418 (Pavliscak) incorporated herein by reference.

The material may comprise a structure such as a barrier, rib, or wall located between plasma-shells. Examples of such barriers, ribs, or walls made wholly or in part from a black material are disclosed in U.S. Pat. Nos. 5,477,105 (Curtin et al.), 5,351,144 (Tanamachi), 5,209,688 (Nishigaki et al.), 5,107,176 (Endo et al.), 4,963,114 (Andreadakis), and 4,725,255 (Shinada et al.), all incorporated herein by reference.

Electrically Conductive Bonding Substance

In one embodiment of this invention, the conductors or electrodes are electrically connected to each plasma-shell with an electrically conductive bonding substance. This may be applied to an exterior surface of the plasma-shell, to an electrode, and/or to the substrate surface. In one embodiment, it is applied to both the plasma-shell and the electrode.

The electrically conductive bonding substance can be any suitable inorganic or organic material including compounds, mixtures, dispersions, pastes, liquids, cements, and adhesives. In one embodiment, the electrically conductive bonding substance is an organic substance with conductive filler material. Contemplated organic substances include adhesive monomers, dimers, trimers, polymers and copolymers of materials such as polyurethanes, polysulfides, silicones, and epoxies. A wide range of other organic or polymeric materials may be used. Contemplated conductive filler materials include conductive metals or metalloids such as silver, gold, platinum, copper, chromium, nickel, aluminum and carbon. The conductive filler may be of any suitable size and form such as particles, powder, agglomerates, or flakes of any suitable size and shape. It is contemplated that the particles, powder, agglomerates, or flakes may comprise a non-metal, metal or metalloid core with an outer layer, coating, or film of conductive metal. Some specific embodiments of conductive filler materials include silver-plated copper beads, silver-plated glass beads, silver particles, silver flakes, gold-plated copper beads, gold-plated glass beads, gold particles, gold flakes, and so forth. In one particular embodiment of this invention there is used an epoxy filled with 60% to 80% silver by weight.

Examples of electrically conductive bonding substances are well known in the art. The disclosures including the compositions of the following references are incorporated herein by reference. U.S. Pat. No. 3,412,043 (Gilliland) discloses an electrically conductive composition of silver flakes and resinous binder. U.S. Pat. No. 3,983,075 (Marshall et al.) discloses a copper filled electrically conductive epoxy. U.S. Pat. No. 4,247,594 (Shea et al.) discloses an electrically conductive resinous composition of copper flakes in a resinous binder. U.S. Pat. Nos. 4,552,607 (Frey) and 4,670,339 (Frey) disclose a method of forming an electrically conductive bond using copper plasma-shells in an epoxy. U.S. Pat. No. 4,880,570 (Sanborn et al.) discloses an electrically conductive epoxy-based adhesive selected from the amine curing modified epoxy family with a filler of silver flakes. U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids. Other noble metals and non-noble metals such as nickel are disclosed. U.S. Pat. No. 5,298,194 (Carter et al.) discloses an electrically conductive adhesive composition comprising a polymer or copolymer of polyolefins or polyesters filled with silver particles. U.S. Pat. No. 5,575,956 (Hermansen et al.) discloses electrically conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed. U.S. Pat. No. 5,891,367 (Basheer et al.) discloses a conductive epoxy adhesive comprising an epoxy resin cured or reacted with selected primary amines and filled with silver flakes. The primary amines provide improved impact resistance. U.S. Pat. No. 5,918,364 (Kulesza et al.) discloses substrate bumps or pads formed of electrically conductive polymers filled with gold or silver. U.S. Pat. No. 6,184,280 (Shibuta) discloses an organic polymer containing hollow carbon microfibers and an electrically conductive metal oxide powder.

In another embodiment, the electrically conductive bonding substance is an organic substance without a conductive filler material. Examples of electrically conductive bonding substances are well known in the art. The disclosures including the compositions of the following references are incorporated herein by reference. Electrically conductive polymer compositions are disclosed in U.S. Pat. Nos. 5,917,693 (Kono et al.), 6,096,825 (Garnier), and 6,358,438 (Isozaki et al.). The electrically conductive polymers disclosed above may also be used with conductive fillers. In some embodiments, organic ionic materials such as calcium stearate may be added to increase electrical conductivity. See U.S. Pat. No. 6,599,446 (Todt et al.), incorporated herein by reference. In one embodiment hereof, the electrically conductive bonding substance is luminescent, for example as disclosed in U.S. Pat. No. 6,558,576 (Brielmann et al.), incorporated herein by reference.

U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers used to form these polymers.

EMI/RFI Shielding

In some embodiments, electroconductive-bonding substances may be used for EMI (electromagnetic interference) and/or RFI (radio-frequency interference) shielding. Examples of such EMI/RFI shielding are disclosed in U.S. Pat. Nos. 5,087,314 (Sandborn et al.) and 5,700,398 (Angelopoulos et al.), both incorporated herein by reference.

Electrodes

One or more hollow plasma-shells containing the ionizable gas are located within the display panel structure, each plasma-shell being in contact with at least two electrodes. The electrodes may contact the surface of the plasma-shell or extend through the plasma-shell so as to be in direct contact with the ionizable gas inside the shell. In accordance with one embodiment of this invention, the contact of the electrode to the shell is augmented with a supplemental electrically conductive bonding substance applied to each plasma-shell, to each electrode, and/or to the PDP substrates so as to form an electrically conductive pad connection to the electrodes. A dielectric substance may also be used in lieu of, or in addition to, the conductive substance. Each electrode pad may partially cover an outside shell surface of the plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. Nos. 3,603,836 (Grier) and 3,701,184 (Grier), incorporated herein by reference. Apertured electrodes may be used as disclosed in U.S. Pat. Nos. 6,118,214 (Marcotte) and 5,411,035 (Marcotte) and U.S. Patent Application Publication 2004/0001034 (Marcotte), all incorporated herein by reference.

The electrode array may be divided into two portions and driven from both sides with a so-called dual scan architecture as disclosed in U.S. Pat. Nos. 4,233,623 (Pavliscak) and 4,320,418 (Pavliscak), both incorporated herein by reference.

A flat plasma-shell surface is particularly suitable for connecting electrodes to the plasma-shell. If one or more electrodes connect to the bottom of the plasma-shell, a flat bottom surface is desirable. Likewise, if one or more electrodes connect to the top or sides of the plasma-shell, it is advantageous for the connecting surface of such top or sides to be flat.

In a matrix display, the electrodes in each opposing transverse array are transverse to the electrodes in the opposing array so that each electrode in each array forms a crossover with an electrode in the opposing array, the two arrays thereby forming a multiplicity of crossovers. Each crossover of two opposing electrodes forms a discharge pixel or cell. At least one hollow plasma-shell containing ionizable gas is positioned in the gas discharge (plasma) display device at the intersection of at least two opposing electrodes. When an appropriate voltage potential is applied to an opposing pair of electrodes, the ionizable gas inside of the plasma-shell at the crossover is energized and a gas discharge occurs. Photons of light in the visible and/or invisible range are emitted by the gas discharge.

Electrode Materials

The electrodes are of any suitable conductive metal or alloy including gold, platinum, silver, aluminum, nickel, copper, chrome, or chrome-copper-chrome. If an electrode transparent to visible light is required on the viewing surface, this is typically indium tin oxide (ITO) or tin oxide with a conductive side or edge bus bar of silver. Other conductive bus bar materials may be used such as gold, aluminum, nickel, or chrome-copper-chrome. For improved electrical contact, the electrodes may partially cover the external surface of the plasma-shell.

The electrodes may contain a secondary electron emission (Townsend coefficient) material such as a coating for secondary electron emission material such as magnesium oxide, especially in a DC PDP. There also may be a protective coating over the cathode, which may be a secondary electron emission material such as magnesium oxide, gadolinium hexaboride or lanthanum hexaboride as disclosed in U.S. Pat. No. 7,145,612 (Sakai et al.), incorporated herein by reference. The rare earth hexaborides are good electron-emitting materials as disclosed in U.S. Pat. No. 5,837,165 (Otani et al.), incorporated herein by reference.

In one embodiment, the anode is composed of lanthanum hexaboride and the cathode is platinum, for example, as disclosed in U.S. Pat. No. 5,643,692 (Ohmi). In some embodiments, one or more of the conductors or electrodes connected to the plasma-shell is composed of or contains a rare earth oxide such as cerium oxide or lanthanum oxide. Also magnesium diboride may be used as a conductor or electrode. In another embodiment, the anode is composed of lanthanum hexaboride and the cathode is platinum, for example, as disclosed in U.S. Pat. No. 5,643,692 (Ohmi).

The materials disclosed above for the shell materials and/or secondary electron emission materials may also be suitable, especially the borides for electrode materials. In addition, magnesium tetraboride and titanium boride are contemplated.

Plasma tends to have a short lifetime because of the sputtering of the cathode electrode. Cathode electrode materials with small work functions and low sputter rates result in lower voltage drive and extend the service life of the gas discharge. In order to achieve this goal, a cathode electrode with a conductive oxide may be used. Another way to extend life is through current limiting means such as using a resistor at each pixel. Increased gas pressure can also extend electrode life.

The electrodes may be applied to the substrate and/or to the plasma-shells by thin film methods such as vapor phase deposition, E-beam evaporation, sputtering, conductive doping, electro-plating, etc. or by thick film methods such as screen printing, ink jet printing, etc.

Plasma-Shell Geometry

As illustrated in the drawings, the plasma-shells may be of any suitable volumetric shape or geometric configuration to encapsulate the ionizable gas independently of the basic PDP structure.

The thickness of the wall of each hollow plasma-shell must be sufficient to retain the gas inside, but thin enough to allow passage of photons emitted by the gas discharge. The wall thickness of the plasma-shell should be kept as thin as practical, but thick enough to retain sufficient strength so that the plasma-shells can be easily handled and pressurized.

The flat or domed side dimensions or gas discharge distance of the plasma-shells may be varied for different phosphors to achieve color balance. The dimensions include length or width. Thus for a gas discharge display having phosphors which emit red, green, and blue light in the visible range, the plasma-shells for the red phosphor may have width and/or length dimensions or gas discharge distance less than the corresponding dimensions or gas discharge distance of the plasma-shells for the green or blue phosphor. Typically the flat or domed base dimensions or gas discharge distance of the plasma-shells for the red phosphor is about 80% to 95% of the corresponding flat or domed base dimensions or gas discharge distance for the green phosphor plasma-shells.

The flat or domed base width and/or length dimensions or gas discharge distance of the blue phosphor plasma-shells may be greater than the flat or domed base width and/or length dimensions or gas discharge distance for the red or green phosphor plasma-shells. Typically the plasma-shell flat or domed base width and/or length dimensions or gas discharge distance for the blue phosphor is about 105% to 125% of the plasma-shell flat or domed base width and/or length dimensions or gas discharge distance for the green phosphor and about 110% to 155% of the flat or domed base width and/or length dimensions or gas discharge distance of the red phosphor.

In another embodiment using a high brightness green phosphor, the red and green plasma-shell may be reversed such that the flat or domed base width and/or length dimensions or gas discharge distance of the green phosphor plasma-shell is about 80% to 95% of the flat or domed base width and/or length dimensions or gas discharge distance of the red phosphor plasma-shell. In this embodiment, the flat or domed base width and/or length dimensions or gas discharge distance of the blue plasma-shell is 105% to 125% of the flat or domed base width and/or length dimensions or gas discharge distance for the red phosphor and about 110% to 155% of the flat or domed base width and/or length dimensions or gas discharge distance of the green phosphor.

The red, green, and blue plasma-shells may also have different dimensions so as to enlarge voltage margin and improve luminance uniformity as disclosed in U.S. Patent Application Publication 2002/0041157 A1 (Heo), incorporated herein by reference. The widths of the corresponding electrodes for each RGB plasma-shell may be of different dimensions such that an electrode is wider or narrower for a selected phosphor as disclosed in U.S. Pat. No. 6,034,657 (Tokunaga et al.), incorporated herein by reference.

There also may be used combinations of different cross sections and/or different geometric shapes for different colors. Thus there may be used a square cross section plasma-shell for one color, a circular cross-section for another color, and another geometric cross section for a third color. A combination of different plasma-shells, i.e., plasma-spheres, plasma-discs, and plasma-domes, for different color pixels in a PDP may be used. Thus a plasma-sphere may be used for one color, a plasma-disc for another color, and/or a plasma-dome for another color.

Organic Luminescent Substances

Organic luminescent substances may be used alone or in combination with inorganic luminescent substances. Contemplated combinations include mixtures and/or selective layers of organic and inorganic substances. In accordance with one embodiment of this invention, an organic luminescent substance is located in close proximity to the enclosed gas discharge within a plasma-shell, so as to be excited by photons from the enclosed gas discharge.

In accordance with one preferred embodiment of this invention, an organic photoluminescent substance is positioned on at least a portion of the external surface of a plasma-shell, so as to be excited by photons from the gas discharge within the plasma-shell, such that the excited photoluminescent substance emits visible and/or invisible light.

As used herein organic luminescent substance comprises one or more organic compounds, monomers, dimers, trimers, polymers, copolymers, or like organic materials, which emit visible and/or invisible light when excited by photons from the gas discharge inside of the plasma-shell. Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent material. All are collectively referred to herein as organic photoluminescent phosphor.

Organic photoluminescent phosphor substances contemplated herein include those organic light-emitting diodes or devices (OLED) and organic electroluminescent (organic EL) materials, which emit light when excited by photons from the gas discharge of a gas plasma discharge. OLED and organic EL substances include the small molecule organic EL and the large molecule or polymeric OLED.

Small molecule organic EL substances are disclosed in U.S. Pat. Nos. 4,720,432 (VanSlyke et al.), 4,769,292 (Tang et al.), 5,151,629 (VanSlyke), 5,409,783 (Tang et al.), 5,645,948 (Shi et al.), 5,683,823 (Shi et al.), 5,755,999 (Shi et al.), 5,908,581 (Chen et al.), 5,935,720 (Chen et al.), 6,020,078 (Chen et al.), 6,069,442 (Hung et al.), 6,348,359 (VanSlyke et al.), and 6,720,090 (Young et al.), all incorporated herein by reference. The small molecule organic light-emitting devices may be called SMOLED.

Large molecule or polymeric OLED substances are disclosed in U.S. Pat. Nos. 5,247,190 (Friend et al.), 5,399,502 (Friend et al.), 5,540,999 (Yamamoto et al.), 5,900,327 (Pei et al.), 5,804,836 (Heeger et al.), 5,807,627 (Friend et al.), 6,361,885 (Chou), and 6,670,645 (Grushin et al.), all incorporated herein by reference. The polymer light-emitting devices may be called PLED. Organic luminescent substances also include OLEDs doped with phosphorescent compounds as disclosed in U.S. Pat. No. 6,303,238 (Thompson et al.), incorporated herein by reference. Organic photoluminescent substances are also disclosed in U.S. Patent Application Publication Nos. 2002/0101151 (Choi et al.), 2002/0063525 (Choi et al.), 2003/0003225 (Choi et al.) and 2003/0052596 (Yi et al.); U.S. Pat. Nos. 6,610,554 (Yi et al.), and 6,692,326 (Choi et al.); and International Publications WO 02/104077 and WO 03/046649, all incorporated herein by reference.

In one embodiment of this invention, the organic luminescent phosphorous substance is a color-conversion-media (CCM) that converts light (photons) emitted by the gas discharge to visible or invisible light. Examples of CCM substances include the fluorescent organic dye compounds.

In another embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials, which may be used as photoluminescent phosphorous substances. U.S. Pat. No. 5,693,808 (Langhals), incorporated herein by reference, discloses the preparation of luminescent perylene dyes. U.S. Patent Application Publication 2004/0009367 (Hatwar), incorporated herein by reference, discloses the preparation of luminescent materials doped with fluorescent perylene dyes. U.S. Pat. No. 6,528,188 (Suzuki et al.), incorporated herein by reference, discloses the preparation and use of luminescent perylene compounds.

These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation. A material with conjugation or extended conjugation absorbs light and then transmits the light to the various conjugated bonds. Typically the number of conjugate-double bonds ranges from about 4 to about 15. Further examples of conjugate-bonded or condensed/fused benzene rings are disclosed in U.S. Pat. Nos. 6,614,175 (Aziz et al.) and 6,479,172 (Hu et al.), both incorporated herein by reference. U.S. Patent Application Publication 2004/0023010 (Bulovic et al.) incorporated herein by reference, discloses luminescent nanocrystals with organic polymers including conjugated organic polymers. Cumulene is conjugated only with carbon and hydrogen atoms. Cumulene becomes more deeply colored as the conjugation is extended. Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference.

The organic luminescent substance may be an organic lumophor, for example as disclosed in U.S. Pat. Nos. 5,354,825 (Klainer et al.), 5,480,723 (Klainer et al.), 5,700,897 (Klainer et al.), and 6,538,263 (Park et al.), all incorporated herein by reference. Also lumophores are disclosed in S. E. Shaheen et al., *Journal of Applied Physics*, Vol. 84, Number 4, pages 2324 to 2327, Aug. 15, 1998; J. D. Anderson et al., *Journal American Chemical Society* 1998, Vol. 120, pages 9646 to 9655; and Gyu Hyun Lee et al., *Bulletin of Korean Chemical Society,* 2002, Vol. 23, NO. 3, pages 528 to 530, all incorporated herein by reference.

Selected Specific Organic Phosphor Embodiments and Applications

The following are some specific embodiments using an organic luminescent substance such as a luminescent phosphor.

Color Plasma Displays Using UV 300 nm to 380 nm Excitation with Organic Phosphors The organic luminescent substance such as an organic phosphor may be excited by UV ranging from about 300 nm to about 380 nm to produce red, blue, or green emission in the visible range. The encapsulated gas is chosen to excite in this range. To improve life, the organic phosphor should be separated from the plasma discharge. This may be accomplished by applying the organic phosphor to the exterior of the shell. In this case, it is important that the shell material be selected such that it is transmissive to UV in the range of about 300 nm to about 380 nm. Suitable materials include aluminum oxides, silicon oxides, and other such materials. In the case where helium is used in the gas mixture, aluminum oxide is a desirable shell material, as it does not allow the helium to permeate.

Color Plasma Displays Using UV Excitation Below 300 nm with Organic Phosphors

UV below 300 nm may excite organic phosphors. In this case, a xenon neon mixture of gases may produce excitation at 147 nm and 172 nm. The plasma-shell material must be transmissive below 300 nm. Shell materials that are transmissive to frequencies below 300 nm include silicon oxide. The thickness of the shell material must be minimized in order to maximize transmissivity.

Color Plasma Displays Using Visible Blue Above 380 nm with Organic Phosphors

Organic phosphors may be excited by excitation above 380 nm. The plasma-shell material is composed completely or partially of an inorganic blue phosphor such as Barium Magnesium Aluminate (BAM). The shell material fluoresces blue and may be up-converted to red or green with organic phosphors on the outside of the shell Infrared Plasma Displays In some applications it may be desirable to have PDP displays with plasma-shells that produce emission in the infrared range. This may be done with up-conversion phosphors as described below.

Application of Organic Phosphors

Organic phosphors may be added to a UV curable medium and applied to the plasma-shell with a variety of methods including jetting, spraying, brushing, sheet transfer methods, spin coating, dip coating, or screen-printing. Thin film deposition processes are contemplated including vapor phase deposition and thin film sputtering at temperatures that do not degrade the organic material. This may be done before or after the plasma-shell is added to a substrate.

Application of Phosphor Before Plasma-Shells are Added to Substrate

If organic phosphors are applied to the plasma-shells before such are applied to the substrate, additional steps may be necessary to place each plasma-shell in the correct position on the substrate.

Application of Phosphor after Plasma-Shells are Added to Substrate

If the organic phosphor is applied to the plasma-shells after such are placed on a substrate, care must be taken to align the appropriate phosphor color with the appropriate plasma-shell.

Application of Phosphor after Plasma-Shells are Added to Substrate Self-Aligning In one embodiment, the plasma-shells may be used to cure the phosphor. A single color organic phosphor is completely applied to the entire substrate containing the plasma-shells. Next the plasma-shells are selectively activated to produce UV to cure the organic phosphor. The phosphor will cure on the plasma-shells that are activated and may be rinsed away from the plasma-shells that were not activated. Additional applications of phosphor of different colors may be applied using this method to coat the remaining shells. In this way the process is completely self-lighting.

Inorganic Luminescent Substances

Inorganic luminescent substances may be used alone or in combination with organic luminescent substances. Contemplated combinations include mixtures and/or selective layers of organic and/or inorganic substances. The shell may be made of an inorganic luminescent substance such as a phosphor. In one embodiment the inorganic luminescent substance is incorporated into the particles forming the shell structure. Typical inorganic luminescent substances are listed below.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb. In one mode and embodiment of this invention using a green light-emitting phosphor, there is used a green light-emitting phosphor selected from the zinc orthosilicate phosphors such as $ZnSiO_4:Mn^{2+}$. Green light-emitting zinc orthosilicates including the method of preparation are disclosed in U.S. Pat. No. 5,985,176 (Rao), which is incorporated herein by reference. These phosphors have a broad emission in the green region when excited by 147 nm and 173 nm (nanometer) radiation from the discharge of a xenon gas mixture. In another mode and embodiment of this invention, there is used a green light-emitting phosphor which is a terbium activated yttrium gadolinium borate phosphor such as $(Gd,Y)BO_3:Tb^{3+}$. Green light-emitting borate phosphors including the method of preparation are disclosed in U.S. Pat. No. 6,004,481 (Rao), which is incorporated herein by reference. In another mode and embodiment there is used a manganese activated alkaline earth aluminate green phosphor as disclosed in U.S. Pat. No. 6,423,248 (Rao), peaking at 516 nm when excited by 147 nm and 173nm radiation from xenon.

The particle size ranges from 0.05 to 5 microns. Rao '248 is incorporated herein by reference. Terbium doped phosphors may emit in the blue region especially in lower concentrations of terbium. For some display applications such as television, it is desirable to have a single peak in the green region at 543 nm. By incorporating a blue absorption dye in a filter, a blue peak may be eliminated. Green light-emitting terbium-activated lanthanum cerium orthophosphate phosphors are disclosed in U.S. Pat. No. 4,423,349 (Nakajima et al.), which is incorporated herein by reference. Green light-emitting lanthanum cerium terbium phosphate phosphors are disclosed in U.S. Pat. No. 5,651,920 (Chau et al.), which is incorporated herein by reference. Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na. In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors, which emit blue visible light, are disclosed in U.S. Pat. Nos. 5,611,959 (Kijima et al.) and 5,998,047 (Bechtel et al.), both incorporated herein by reference. The aluminate phosphors may also be selectively coated as disclosed by Bechtel et al. '047. Blue light-emitting phosphors may be selected from a number of divalent europium-activated aluminates such as disclosed in U.S. Pat. No. 6,096,243 (Oshio et al.) incorporated herein by reference. The preparation of BAM phosphors for a PDP is also disclosed in U.S. Pat. No. 6,045,721 (Zachau et al.), incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao), which is incorporated herein by reference.

In one best mode and embodiment of this invention using a blue light-emitting phosphor, a mixture or blend of blue light-emitting phosphors is used such as a blend or complex of about 70% to 85% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference. A blue BAM phosphor with partially substituted $Eu^{2+}$ is disclosed in U.S. Pat. No. 6,833,672 (Aoki et al.) and is also incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference. Other blue light-emitting phosphors include europium-activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S:Eu$ and $Y_2O_3S:Eu$. In a best mode and embodiment of this invention using a red-emitting phosphor, there is used a red light-emitting phosphor which is an europium activated yttrium gadolinium borate phosphors such as $(Y,Gd)BO_3:Eu^{3+}$. The composition and preparation of these red light-emitting borate phosphors is disclosed in U.S. Pat. Nos. 6,042,747 (Rao) and 6,284,155 (Rao), both incorporated herein by reference. These europium activated yttrium, gadolinium borate phosphors emit an orange line at 593 nm and red emission lines at 611 nm and 627 nm when excited by 147 nm and 173 nm UV radiation from the discharge of a xenon gas mixture. For television (TV) applications, it is preferred to have the red emission lines (611 nm and 627 nm). The orange line (593 nm) may be minimized or eliminated with an external optical filter. A wide range of red light-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter. Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$. White light-emitting phosphors are disclosed in U.S. Pat. No. 6,200,496 (Park et al.) incorporated herein by reference. Pink light-emitting phosphors are disclosed in U.S. Pat. No. 6,200,497 (Park et al.) incorporated herein by reference. Phosphor material which emits yellow light also includes ZnS:Au.

Organic and Inorganic Luminescent Materials

Inorganic and organic luminescent materials may be used in selected combinations. In one embodiment, multiple layers of luminescent materials are applied to the plasma-shell with at least one layer being organic and at least one layer being inorganic. An inorganic layer may serve as a protective overcoat for an organic layer.

In another embodiment, the shell of the plasma-shell comprises or contains inorganic luminescent material. In another embodiment, organic and inorganic luminescent materials are mixed together and applied as a layer inside or outside the shell. The shell may also be made of or contain a mixture of organic and inorganic luminescent materials. In one preferred embodiment, a mixture of organic and inorganic material is applied outside the shell.

Photon Exciting of Luminescent Substance

In one embodiment contemplated in the practice of this invention, a layer, coating, or particles of an inorganic and/or organic luminescent substance such as phosphor is located on part or all of the exterior wall surfaces of the plasma-shell. The photons of light pass through the shell or wall(s) of the plasma-shell and excite the organic or inorganic photoluminescent phosphor located outside of the plasma-shell. Typically this is red, blue, or green light. However, phosphors may be used which emit other light such as white, pink, or yellow light. In some embodiments of this invention, the emitted light may not be visible to the human eye. Up-conversion or down-conversion phosphors may be used.

The phosphor may be located on the side wall(s) of a channel, trench, barrier, rib, groove, cavity, well, hollow or like structure of the discharge space. In some embodiments, the wall(s) are made of phosphor. The gas discharge within the channel, trench, barrier, groove, cavity, well or hollow produces photons that excite the inorganic and/or organic phosphor such that the phosphor emits light in a range visible to the human eye or invisible light in the UV and/or IR range.

In the prior art, AC plasma display structures as disclosed in U.S. Pat. Nos. 5,793,158 (Wedding) and 5,661,500 (Shinoda et al.) incorporated herein by reference, inorganic and/or organic phosphor is located on the wall(s) or side(s) of the barriers that form the channel, trench, groove, cavity, well, or hollow. Phosphor may also be located on the bottom of the channel, trench or groove as disclosed by Shinoda et al. '500 or the bottom cavity, well, or hollow as disclosed by U.S. Pat. No. 4,827,186 (Knauer et al.) incorporated herein by reference. The plasma-shells are positioned within or along the walls of a channel, barrier, trench, groove, cavity, well or hollow so as to be in close proximity to the phosphor such that photons from the gas discharge within the plasma-shell cause the phosphor along the wall(s), side(s), or at the bottom of the channel, barrier, trenches groove, cavity, well, or hollow, to emit light in the visible and/or invisible range.

In one embodiment of this invention, phosphor is located on the outside surface of each plasma-shell. In this embodiment, the outside surface is at least partially covered with phosphor that emits light in the visible or invisible range when excited by photons from the gas discharge within the plasma-shell. The phosphor may emit light in the visible, UV, and/or IR range.

In one embodiment, phosphor is dispersed and/or suspended within the ionizable gas inside each plasma-shell. In such embodiment, the phosphor particles are sufficiently small such that most of the phosphor particles remain suspended within the gas and do not precipitate or otherwise substantially collect on the inside wall of the plasma-shell. The average diameter of the dispersed and/or suspended phosphor particles is less than about 1 micron, typically less than 0.1 micron. Larger particles can be used depending on the size of the plasma-shell. The phosphor particles may be introduced by means of a fluidized bed.

The luminescent substance such as an inorganic and/or organic luminescent phosphor may be located on all or part of the external surface of the plasma-shells and/or on all or part of the internal surface of the plasma-shells. The phosphor may comprise particles dispersed or floating within the gas. In another embodiment, the luminescent material is incorporated into the shell of the plasma-shell.

The inorganic and/or organic luminescent substance is located on the external surface and is excited by photons from the gas discharge inside the plasma-shell. The phosphor emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors.

The phosphor thickness is sufficient to absorb the UV, but thin enough to emit light with minimum attenuation. Typically the phosphor thickness is about 2 to 40 microns, preferably about 5 to 15 microns. In one embodiment, dispersed or floating particles within the gas are typically spherical or needle shaped having an average size of about 0.01 to 5 microns.

A UV photoluminescent phosphor is excited by UV in the range of 50 to 400 nanometers. The phosphor may have a protective layer or coating which is transmissive to the excitation UV and the emitted visible light. Such include organic films such as perylene or inorganic films such as aluminum oxide or silica. Protective overcoats are disclosed and discussed below. Because the ionizable gas is contained within a multiplicity of plasma-shells, it is possible to provide a custom gas mixture or composition at a custom pressure in each plasma-shell for each phosphor. In the prior art, it is necessary to select an ionizable gas mixture and a gas pressure that is optimum for all phosphors used in the device such as red, blue, and green phosphors. However, this requires trade-offs because a particular gas mixture may be optimum for a particular green phosphor, but less desirable for red or blue phosphors. In addition, trade-offs are required for the gas pressure. In the practice of this invention, an optimum gas mixture and an optimum gas pressure may be provided for each of the selected phosphors. Thus the gas mixture and gas pressure inside the plasma-shells may be optimized with a custom gas mixture and a custom gas pressure, each or both optimized for each phosphor emitting red, blue, green, white, pink, or yellow light in the visible range or light in the invisible range. The diameter and the wall thickness of the plasma-shell can also be adjusted and optimized for each phosphor. Depending upon the Paschen Curve (pd v. voltage) for the particular ionizable gas mixture, the operating voltage may be decreased by optimized changes in the gas mixture, gas pressure, and the dimensions of the plasma-shell including the distance between electrodes.

Up-Conversion

In another embodiment of this invention it is contemplated using an inorganic and/or organic luminescent substance such as a phosphor for up-conversion, for example to convert infrared radiation to visible light. Up-conversion materials include phosphors and are disclosed in U.S. Pat. Nos. 3,623,907 (Watts), 3,634,614 (Geusic), 5,541,012 (Ohwaki et al.), 6,265,825 (Asano), and 6,624,414 (Glesener), all incorporated herein by reference. Up-conversion may also be obtained with shell compositions such as thulium doped silicate glass containing oxides of Si, Al, and La, as disclosed in U.S. Patent Application Publication 2004/0037538 (Schardt et al.), incorporated herein by reference. The glasses of Schardt et al. emit visible or UV light when excited by IR. Glasses for up-conversion are also disclosed in Japanese Patents 9054562 and 9086958 (Akira et al.), both incorporated herein by reference.

U.S. Pat. No. 5,166,948 (Gavrilovic) incorporated herein by reference, discloses an up-conversion crystalline structure. U.S. Pat. No. 6,726,992 (Yadav et al.) incorporated herein by reference, discloses nano-engineered luminescent materials including both Stokes and Anti-Stokes phosphors. It is contemplated that the plasma-shell shell may be constructed wholly or in part from an up-conversion material, down-conversion material or a combination of both.

Down-Conversion

The luminescent material may also include down-conversion materials such as phosphors as disclosed in U.S. Pat. No. 3,838,307 (Masi), incorporated herein by reference. Down-conversion luminescent materials are also disclosed in U.S. Pat. Nos. 6,013,538 (Burrows et al.), 6,091,195 (Forrest et al.), 6,208,791 (Bischel et al.), 6,566,156 (Sturm et al.) and 6,650,045 (Forrest et al.) incorporated herein by reference. Down-conversion luminescent materials are also disclosed in U.S. Patent Application Publication Nos. 2004/0159903 (Burgener II et al.), 2004/0196538 (Burgener, II et al.), 2005/0093001 (Liu et al.), and 2005/0094109 (Sun et al.) incorporated herein by reference. Anti-Stokes phosphors are also disclosed in European Patent 0143034 (Maestro et al.), which is also incorporated herein by reference. As noted above, the plasma-shell may be constructed wholly or in part from a down-conversion material, up-conversion material or a combination of both.

Application of Luminescent Materials

The organic and/or inorganic luminescent substance may be applied by any suitable method to the external surface of the plasma-shell, to the substrate or to any location in close proximity to the gas discharge contained within the plasma-shell. Such methods include thin film deposition methods such as vapor phase deposition, sputtering and E-beam evaporation. Also thick film application methods may be used such as screen-printing, ink jet printing, and/or slurry techniques. Small size molecule OLED materials are typically deposited upon the external surface of the plasma-shell by thin film deposition methods such as vapor phase deposition or sputtering. Large size molecule or polymeric OLED materials are deposited by so called thick film application methods such as screen-printing, ink jet, and/or slurry techniques. If the organic and/or inorganic luminescent substance is applied to the external surface of the plasma-shell, such may be applied as a continuous or discontinuous layer or coating so as to completely or partially cover the plasma-shell with the luminescent substance. A spraying method for depositing phosphors is disclosed in U.S. Pat. No. 5,876,542 (Fujiwara). The luminescent material may also be incorporated into the shell material and/or added to the inside of the plasma-shell during shell formation or after the shell is formed.

Quantum Dots

In one embodiment of this invention, the luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference. Luminescent quantum dots are also disclosed in U.S. Pat. Nos. 6,468,808 (Nie et al.), 6,501,091 (Bawendi et al.), 6,698,313 (Park et al.), and U.S. Patent Application Publication 2003/0042850 (Bertram et al.), all incorporated herein by reference. The quantum dots may be added or incorporated into the shell during shell formation or after the shell is formed.

Protective Overcoat for Luminescent Substance

In one embodiment, an organic and/or inorganic luminescent substance is located on an external surface of the plasma-shell and/or at an external location such as on the substrate near the plasma-shell. Organic luminescent phosphors are particularly suitable for placing on the exterior shell surface, but may require a protective overcoat. The protective overcoat may be inorganic, organic, or a combination of inorganic and organic. This protective overcoat may be an inorganic and/or organic luminescent material.

The luminescent substance may have a protective overcoat such as a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen print, ink jet, or other convenient methods so as to form a clear film or coating of the acrylic compound over the luminescent substance.

Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment.

In one embodiment hereof the luminescent substance is coated with a film or layer of a parylene compound including monomers, dimers, trimers, polymers, copolymers, and derivatives thereof. The parylene compounds are widely used as protective films. Specific compounds including poly-monochloro-para-xylyene (Parylene C) and poly-para-xylylene (Parylene N). Parylene polymer films are also disclosed in U.S. Pat. Nos. 5,879,808 (Wary et al.) and U.S. Pat. No. 6,586,048 (Welch et al.), both incorporated herein by reference. The parylene compounds may be applied by ink jet printing, screen printing, spraying, and so forth as disclosed in U.S. Patent Application Publication 2004/0032466 (Deguchi et al.), incorporated herein by reference. Parylene conformal coatings are covered by Mil-I-46058C and ISO 9002. Parylene films may also be induced into fluorescence by an active plasma as disclosed in U.S. Pat. No. 5,139,813 (Yira et al.), incorporated herein by reference.

Phosphor overcoats are also disclosed in U.S. Pat. Nos. 4,048,533 (Hinson et al.), 4,315,192 (Skwirut et al.), 5,592,052 (Maya et al.), 5,604,396 (Watanabe et al.), 5,793,158 (Wedding), and 6,099,753 (Yoshimura et al.), all incorporated herein by reference. In some embodiments, the luminescent substance is selected from materials that do not degrade when exposed to oxygen, moisture, sunlight, etc. and that may not require a protective overcoat. Such include various organic luminescent substances such as the luminescent perylene compounds disclosed above. For example, luminescent perylene compounds may be used as protective overcoats and thus do not require a protective overcoat.

Tinted Plasma-Shells

In the practice of this invention, the plasma-shell may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber '690. The use of tinted materials and/or gas discharges emitting light of different wavelengths may be used in combination with the above described phosphors and the light emitted from such phosphors. Optical filters may also be used.

Filters

This invention may be practiced in combination with an optical and/or electromagnetic (EMI) filter, screen and/or shield. It is contemplated that the filter, screen, and/or shield may be positioned on a PDP constructed of plasma-shells, for example on the front or top-viewing surface. The plasma-shells may also be tinted. Examples of optical filters, screens, and/or shields are disclosed in U.S. Pat. Nos. 3,960,754 (Woodcock), 4,106,857 (Snitzer), 4,303,298, (Yamashita), 5,036,025 (Lin), 5,804,102 (Oi), and 6,333,592 (Sasa et al.), all incorporated herein by reference. Examples of EMI filters, screens, and/or shields are disclosed in U.S. Pat. Nos. 6,188,174 (Marutsuka) and 6,316,110 (Anzaki et al.), incorporated herein by reference. Color filters may also be used. Examples are disclosed in U.S. Pat. Nos. 3,923,527 (Matsuura et al.), 4,105,577 (Yamashita), 4,110,245 (Yamashita), and 4,615,989 (Ritze), all incorporated herein by reference.

IR Filters

The plasma-shell PDP may contain an infrared (IR) filter. An IR filter may be selectively used with one or more plasma-shells to absorb or reflect IR emissions from the display. Such IR emissions may come from the gas discharge inside a plasma-shell and/or from a luminescent material inside and/or outside of a plasma-shell. An IR filter is necessary if the display is used in a night vision application such as with night vision goggles. With night vision goggles, it is typically necessary to filter near IR above about 650 nm (nanometers), generally about 650 nm to about 900 nm.

In some applications the plasma-shell may comprise an IR filter material. Examples of IR filter materials include cyanine compounds such as phthalocyanine and naphthalocyanine compounds as disclosed in U.S. Pat. Nos. 5,804,102 (Oi et al.), 5,811,923 (Zieba et al.), and 6,297,582 (Hirota et al.), all incorporated herein by reference. The IR compound may also be an organic dye compound such as anthraquinone as disclosed in Hirota et al. '582 and tetrahedrally coordinated transition metal ions of cobalt and nickel as disclosed in U.S. Pat. No. 7,081,991 (Jones et al.), incorporated herein by reference.

Optical Interference Filter

The filter may comprise an optical interference filter comprising a layer of low refractive index material and a layer of high refractive index material, as disclosed in U.S. Pat. Nos. 4,647,812 (Vriens et al.) and 4,940,636 (Brock et al.), both incorporated herein by reference. Examples of low refractive index materials include magnesium fluoride and silicon dioxide such as amorphous $SiO_2$.

Examples of high refractive index materials include tantalum oxide and titanium oxide. In one embodiment, the high refractive index material is titanium oxide and at least one metal oxide selected from zirconium oxide, hafnium oxide, tantalum oxide, magnesium oxide, and calcium oxide. In one embodiment, each plasma-shell is composed of a low refraction index material and a high refraction index material.

Mixtures of Luminescent Materials

It is contemplated that mixtures of luminescent materials may be used including inorganic and inorganic, organic and organic, and inorganic and organic. The brightness of the luminescent material may be increased by dispersing inorganic materials into organic luminescent materials or vice versa. Stokes or Anti-Stokes materials may be used.

Layers of Luminescent Materials

Two or more layers of the same or different luminescent materials may be selectively applied to the plasma-shells. Such layers may comprise combinations of organic and organic, inorganic and inorganic, and/or inorganic and organic.

Combinations of Plasma-Shells

In the practice of this invention, the plasma-shells of one geometric shape may be used alone or in combination with other plasma-shells of different geometric shapes. Thus the plasma-discs may contain selected organic and/or inorganic luminescent materials to provide one color in combination with other plasma-shells such as plasma-spheres and/or plasma-domes that contain selected organic and/or or inorganic luminescent materials to provide other colors.

Stacking of Plasma-Shells

In a multicolor display such as RGB PDP, plasma-shells with flat sides such as plasma-domes or plasma-discs may be stacked on top of each other or arranged in parallel side-by-side positions on the substrate. This configuration requires less area of the display surface compared to conventional RGB displays that require red, green and blue pixels adjacent to each other on the substrate. This stacking embodiment may be practiced with plasma-domes or plasma-discs that use various color-emitting gases such as the excimer gases. Luminescent material coated plasma-shells in combination with excimers may also be used. Each plasma-shell may also be of a different color material such as tinted glass.

Plasma-Shells Combined with Plasma Tubes

The PDP structure may comprise a combination of plasma-shells and plasma-tubes. Plasma-tubes comprise elongated tubes for example as disclosed in U.S. Pat. Nos. 3,602,754 (Pfaender et al.), 3,654,680 (Bode et al.), 3,927,342 (Bode et al.), 4,038,577 (Bode et al.), 3,969,718 (Stom), 3,990,068 (Mayer et al.), 4,027,188 (Bergman), 5,984,747 (Bhagavatula et al.), 6,255,777 (Kim et al.), 6,633,117 (Shinoda et al.), 6,650,055 (Ishimoto et al.), and 6,677,704 (Ishimoto et al.), all incorporated herein by reference.

As used herein, the elongated plasma-tube is intended to include capillary, filament, filamentary, illuminator, hollow rod, or other such terms. It includes an elongated enclosed gas-filled structure having a length dimension that is greater than its cross-sectional width dimension. The width of the plasma-tube is the viewing width from the top or bottom (front or rear) of the display. A plasma-tube has multiple gas discharge pixels of 100 or more, typically 500 to 1000 or more, whereas a plasma-shell typically has only one gas discharge pixel. In some embodiments, the plasma-shell may define more than one pixel, i.e., 2, 3, or 4 pixels up to 10 pixels.

The length of each plasma-tube may vary depending upon the PDP structure. In one embodiment hereof, an elongated tube is selectively divided into a multiplicity of lengths. In another embodiment, there is used a continuous tube that winds or weaves back and forth from one end to the other end of the PDP.

The plasma-shells and/or plasma-tubes may be arranged in any configuration. In one embodiment, there are alternating rows of plasma-shells and plasma-tubes. The plasma-tubes may be used for any desired function or purpose including the priming or conditioning of the plasma-shells. In one embodiment, the plasma-tubes are arranged around the perimeter of the display to provide priming or conditioning of the plasma-shells. The plasma-tubes may be of any geometric cross-section including circular, elliptical, square, rectangular, triangular, polygonal, trapezoidal, pentagonal or hexagonal. The plasma-tube may contain secondary electron emission materials, luminescent materials, and reflective materials as discussed herein for plasma-shells. The plasma-tubes may also utilize positive column discharge as discussed herein for plasma-shells. Positive column discharge is disclosed in U.S. Pat. Nos. 7,176,628, 7,157,854 and 7,122,961 all issued to Carol Ann Wedding and incorporated herein by reference.

Luminescent Material Positioned Between Plasma-Shells

The luminescent substance or material is positioned between plasma-shells and excited by the gas discharge within one or more plasma-shells. The luminescent substance may be organic, inorganic, or a combination of organic and inorganic substances including mixtures of organic and inorganic materials. Up-conversion and/or down conversion materials may be used.

In one embodiment, a barrier, rib, or wall is made of a luminescent substance with one or more plasma-shells and/or plasma-tubes located next to the barrier. Examples of PDP barriers made of luminescent materials such as phosphors are disclosed in U.S. Pat. Nos. 5,352,478 (Miyake et al.) and 5,136,207, (Miyake et al.) and incorporated herein by reference.

Summary

Aspects of this invention may be practiced with a coplanar or opposing substrate PDP as disclosed in the U.S. Pat. Nos. 5,793,158 (Wedding) and 5,661,500 (Shinoda et al.). There also may be used a single substrate or monolithic PDP as disclosed in the U.S. Pat. Nos. 3,646,384 (Lay), 3,860,846 (Mayer), 3,935,484 (Dick et al.) and other single substrate patents, discussed above and incorporated herein by reference.

In the practice of this invention, the plasma-shells may be positioned and spaced in a gas discharge plasma display structure so as to utilize and take advantage of the positive column of the gas discharge. The Positive column is described in U.S. Pat. No. 6,184,848 (Weber) and is incorporated herein by reference.

Although this invention has been disclosed and described above with reference to dot matrix gas discharge displays, it may also be used in an alphanumeric gas discharge display using segmented electrodes. This invention may also be practiced in AC or gas discharge displays including hybrid structures of both AC and gas discharge.

The plasma-shells may contain a gaseous mixture for a gas discharge display or may contain other substances such as an electroluminescent (EL) or liquid crystal materials for use with other displays technologies including electroluminescent displays (ELD), liquid crystal displays (LCD), field emission displays (FED), electrophoretic displays, and Organic EL or Organic LED (OLED).

The use of plasma-shells on a single flexible or bendable substrate allows the encapsulated pixel display device to be utilized in a number of applications. In one application, the device is used as a plasma shield to absorb electromagnetic radiation and to make the shielded object invisible to enemy radar. In this embodiment, a flexible sheet of plasma-shells may be provided as a blanket over the shielded object. A flexible sheet of plasma-shells may be rolled up like a rug for transport.

In another embodiment, the PDP device is used to detect radiation such as nuclear radiation from a nuclear device, mechanism, apparatus or container. This is particularly suitable for detecting hidden nuclear devices at airports, loading docks, bridges, and other such locations.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A single substrate gas discharge device comprising a multiplicity of pixels, each pixel being defined by a hollow shell filled with an ionizable gas that produces photons during gas discharge when an appropriate voltage is applied to the gas, each of said gas filled shells being located on the surface of a single common substrate and being connected to two or more electrodes for providing voltages to each of said gas filled shells, said electrodes being located on the substrate.

2. The invention of claim 1 wherein each hollow shell is connected to three or more electrodes.

3. The invention of claim 1 wherein the distance between the electrodes connected to each hollow shell is sufficient for a positive column discharge within said hollow shell.

4. The invention of claim 1 wherein the ionizable gas within each hollow shell comprises one or more members selected from the rare gases, halogens, excimers, and/or mixtures thereof.

5. The invention of claim 1 wherein the gas pressure is selected to allow the gas to ionize when a low voltage is applied.

6. The invention of claim 1 wherein the ionizable gas within each hollow shell includes a mixture of neon and argon, neon and xenon, neon and krypton, neon and helium, argon and xenon, argon and krypton, argon and helium, xenon and krypton, xenon and helium, or krypton and helium.

7. The invention of claim 1 wherein each shell is in the geometric shape of a sphere, a disc, or a dome.

8. The invention of claim 1 wherein the substrate is rigid, flexible, or semi-flexible.

9. The invention of claim 1 wherein, said substrate being flexible such that the device is bendable and rollable in two or more directions.

10. The invention of claim 1 wherein at least one electrode extends through the substrate so as to be in electrical contact with a shell on the surface of the substrate.

11. A single substrate gas discharge device comprising a multiplicity of pixels and a single common substrate, each pixel being defined by a hollow shell filled with an ionizable gas, each gas filled shell being positioned on the surface of the common single substrate and being electrically connected to two or more electrodes located on the common substrate, each electrode being electrically connected to appropriate electronic circuitry for providing voltages to each gas filled shell so as to cause a gas discharge within said shell.

12. The invention of claim 11 wherein each hollow shell is connected to three or more electrodes, at least one of which extends through the substrate in contact with the shell.

13. The invention of claim 11 wherein the ionizable gas within each hollow shell comprises one or more gases selected from the rare gases, halogens, excimers, and/or mixtures thereof.

14. The invention of claim 11 wherein the substrate is rigid, flexible, or semi-flexible.

15. The invention of claim 11 wherein each hollow shell is a sphere, disc, or dome.

16. In a method of fabricating a single substrate gas discharge device comprising a multiplicity of pixels, the improvement which comprises positioning a multiplicity of ionizable gas filled hollow shells on a surface of a single common substrate, and electrically contacting at least two electrodes to each shell, said electrodes being located on the substrate, each pixel being defined by a gas filled hollow shell of said multiplicity of gas filled hollow shells.

17. The invention of claim 16 wherein three or more electrodes are connected to each shell.

18. The invention of claim 16 wherein the substrate has a surface with a multiplicity of cavities, each shell being positioned within a selected cavity.

19. The invention of claim 16 wherein the substrate is rigid, flexible, or semi-flexible.

20. The invention of claim 16 wherein each hollow shell is a sphere, disc, or dome.

* * * * *